US012790047B2

(12) United States Patent
Holmes et al.

(10) Patent No.: US 12,790,047 B2
(45) Date of Patent: Nov. 10, 2026

(54) SEALING SYSTEM FOR BLISTER CARDS

(71) Applicant: RXSAFE LLC, Vista, CA (US)

(72) Inventors: William K. Holmes, San Diego, CA (US); Tom F. Gaasch, Encinitas, CA (US)

(73) Assignee: RXSAFE LLC, Vista, CA (US)

( * ) Notice: Subject to any disclaimer, the term of this patent is extended or adjusted under 35 U.S.C. 154(b) by 0 days.

(21) Appl. No.: 19/029,215

(22) Filed: Jan. 17, 2025

(65) Prior Publication Data

US 2026/0208895 A1 Jul. 23, 2026

(51) Int. Cl.
*B65B 7/16* (2006.01)
*B65B 11/52* (2006.01)
*B65B 61/02* (2006.01)

(52) U.S. Cl.
CPC ..... *B65B 7/162* (2013.01); *B65B 11/52* (2013.01); *B65B 61/025* (2013.01)

(58) Field of Classification Search
CPC ..... B65B 7/162; B65B 11/52; B65B 61/025
See application file for complete search history.

(56) References Cited

U.S. PATENT DOCUMENTS

| | | | |
|---|---|---|---|
| 3,195,284 | A | 7/1965 | Crane, Jr. |
| 3,701,297 | A | 10/1972 | Kovic |
| 3,874,143 | A | 4/1975 | Braber |
| 3,946,537 | A | 3/1976 | Hair et al. |
| 5,329,750 | A | 7/1994 | Bagley et al. |
| 5,623,816 | A | 4/1997 | Edwards et al. |
| 5,720,154 | A | 2/1998 | Lasher et al. |
| 5,771,657 | A | 6/1998 | Lasher et al. |
| 6,604,342 | B1 | 8/2003 | Appelbaum |
| 6,805,259 | B2 | 10/2004 | Stevens et al. |
| 6,898,919 | B2 | 5/2005 | Kim |
| 7,225,597 | B1 | 6/2007 | Knoth |
| 7,765,776 | B1 | 8/2010 | Leu et al. |
| 7,934,355 | B2 | 5/2011 | Strub et al. |
| 8,406,916 | B2 | 3/2013 | Bentele et al. |
| 10,317,348 | B2 | 6/2019 | Van Den Brink |
| 10,926,901 | B2 | 2/2021 | Kim |
| 11,299,307 | B2 | 4/2022 | Haller et al. |
| 11,673,698 | B2 | 6/2023 | Lebel et al. |
| 2003/0213555 | A1 | 11/2003 | Bernardi et al. |
| 2004/0094050 | A1 | 5/2004 | Ackley, Jr. et al. |
| 2004/0261371 | A1 | 12/2004 | Agostini et al. |
| 2005/0145605 | A1 | 7/2005 | Faour et al. |

(Continued)

FOREIGN PATENT DOCUMENTS

| | | | | |
|---|---|---|---|---|
| CN | 115571432 A | * | 1/2023 | ..... B65B 61/025 |
| EP | 2754614 A1 | | 7/2014 | |

(Continued)

OTHER PUBLICATIONS

Translation of CN 115571432 A (Year: 2023).*

(Continued)

*Primary Examiner* — Thomas M Wittenschlaeger
(74) *Attorney, Agent, or Firm* — MICHAEL BEST & FRIEDRICH LLP

(57) ABSTRACT

A sealing system may include a lid roll dispensing a lid for a blister card. A sealing system may include a print roller configured to simultaneously apply the lid from the lid roll on the blister card and print information related to the blister card on the lid.

14 Claims, 15 Drawing Sheets

(56) References Cited

U.S. PATENT DOCUMENTS

| | | | | |
|---|---|---|---|---|
| 2008/0116106 | A1* | 5/2008 | Lampropoulos | A45C 11/24 53/425 |
| 2008/0223001 | A1 | 9/2008 | Monti | |
| 2009/0044489 | A1 | 2/2009 | Siegel | |
| 2009/0044497 | A1 | 2/2009 | Falat et al. | |
| 2009/0050267 | A1 | 2/2009 | Conlon et al. | |
| 2009/0133362 | A1 | 5/2009 | Bentele et al. | |
| 2009/0173779 | A1 | 7/2009 | Szesko et al. | |
| 2009/0260322 | A1* | 10/2009 | Fischer | B65B 41/16 53/167 |
| 2009/0320721 | A1 | 12/2009 | Knoth | |
| 2009/0321465 | A1 | 12/2009 | Knoth et al. | |
| 2009/0321469 | A1 | 12/2009 | Knoth | |
| 2009/0321472 | A1 | 12/2009 | Knoth | |
| 2010/0089997 | A1 | 4/2010 | Carson et al. | |
| 2010/0175352 | A1 | 7/2010 | Soloman | |
| 2010/0251666 | A1 | 10/2010 | Gonzalez et al. | |
| 2011/0071185 | A1 | 3/2011 | Bunick et al. | |
| 2011/0083940 | A1 | 4/2011 | Nazari | |
| 2011/0094327 | A1 | 4/2011 | Knoth | |
| 2011/0208352 | A1 | 8/2011 | Knoth | |
| 2011/0278319 | A1 | 11/2011 | Knoth | |
| 2011/0303692 | A1 | 12/2011 | Kim | |
| 2012/0290129 | A1 | 11/2012 | Luciano, Jr. et al. | |
| 2012/0296592 | A1 | 11/2012 | Luciano, Jr. et al. | |
| 2013/0212987 | A1 | 8/2013 | Shigeyama et al. | |
| 2013/0318931 | A1 | 12/2013 | Holmes | |
| 2014/0025545 | A1 | 1/2014 | Carson et al. | |
| 2014/0230376 | A1 | 8/2014 | Knoth | |
| 2014/0318078 | A1 | 10/2014 | Kondo et al. | |
| 2014/0367301 | A1 | 12/2014 | Kim | |
| 2015/0127145 | A1 | 5/2015 | Kim | |
| 2016/0304229 | A1 | 10/2016 | Hellenbrand | |
| 2017/0015445 | A1 | 1/2017 | Holmes | |
| 2017/0016836 | A1 | 1/2017 | van den Brink | |
| 2017/0057682 | A1 | 3/2017 | Chudy | |
| 2018/0265232 | A1 | 9/2018 | Kim | |
| 2018/0308014 | A1 | 10/2018 | White et al. | |
| 2019/0107501 | A1 | 4/2019 | Mehregany | |
| 2019/0112080 | A1 | 4/2019 | Holmes | |
| 2019/0127094 | A1* | 5/2019 | Noda | B65D 75/367 |
| 2019/0127102 | A1 | 5/2019 | Chudy et al. | |
| 2019/0337647 | A1 | 11/2019 | Yokoyama et al. | |
| 2020/0182799 | A1 | 6/2020 | Inoguchi | |
| 2020/0182800 | A1 | 6/2020 | Inoguchi | |
| 2020/0391887 | A1 | 12/2020 | Takada et al. | |
| 2023/0141858 | A1 | 5/2023 | Arsenault et al. | |
| 2023/0184692 | A1 | 6/2023 | Oda et al. | |
| 2024/0040230 | A1 | 2/2024 | Taguchi et al. | |
| 2024/0158117 | A1 | 5/2024 | Kim | |
| 2025/0256877 | A1 | 8/2025 | Singh et al. | |
| 2025/0256880 | A1 | 8/2025 | Gessner et al. | |

FOREIGN PATENT DOCUMENTS

| | | | | |
|---|---|---|---|---|
| GB | 722485 | A * | 1/1955 | B65B 61/025 |
| JP | 2020016506 | A | 1/2020 | |
| WO | 2017043430 | A1 | 3/2017 | |
| WO | 2019075462 | A1 | 4/2019 | |
| WO | 2019172317 | A1 | 9/2019 | |
| WO | 2019195629 | A1 | 10/2019 | |
| WO | 2020057807 | A1 | 3/2020 | |
| WO | 2021080353 | A2 | 4/2021 | |
| WO | 2022211423 | A1 | 10/2022 | |

OTHER PUBLICATIONS

"BlistAssist by RxSafe | Blister Card Filling Automation Solution" by RxSafe, a YouTube video uploaded Nov. 27, 2018; https://www.youtube.com/watch?v=kzJNBhYTD2I (Year: 2018) (1 page).

RapidCardRx, Multi-Med, Single Dose, Pre-Pack Adherence Blister Card Packager with Universal Cartridges for any Pharmacy, Product Literature, revised Mar. 30, 2020, (2 Pages).

RapidCardRx, Blister Card Filling Automation, Product information from website: https://rxsafe.com/solutions/rapidcardrx/, accessed Apr. 1, 2020, (9 Pages).

RxSafe, LLC, Announces New Blister Card Pakaging Automation, website: https://www.prweb.com/releases/rxsafe_lie_announces_new_blister_card_packaging_automation/prweb17017233.htm, Mar. 31, 2020, (3 Pages).

International Search Report with Written Opinion for related Application No. PCT/US2021/025314 dated Aug. 17, 2021, (16 Pages).

BlistAssist by RxSafe, Blister Card Filling Automation Solution (RxSafe), Nov. 27, 2018, retrieved from URL: https://www.youtube.com/watch?v=kzJNBhYTD2l >, 2 screenshots.

* cited by examiner

SEALING SYSTEM FOR BLISTER CARDS

FIELD

The present disclosure relates to a sealing system for blister cards.

BACKGROUND

Pharmacies use several types of packaging to provide pharmaceutical products or medications to consumers. The types of packaging may include strip packages, blister cards, pill vials, and the like. Pill vials and strip packages are most appropriate for individual customers of retail pharmacies. However, institutional customers, for example, nursing homes, palliative or hospice facilities, hospitals, and the like use blister cards extensively.

SUMMARY

A lid is attached to a blister card after filling. The lid includes information regarding the blister card, for example, patient name, facility name, dosage, and/or the like. The information may be handwritten or printed. Attaching and printing the lid typically introduces additional delay in the filling process of the blister card. Accordingly, there is a need for a sealing system for blister cards that reduce the filling time of the blister card.

In some aspects, the techniques described herein relate to a sealing assembly including: a lid roll dispensing a lid for a blister card; and a print roller configured to simultaneously apply the lid from the lid roll on the blister card and print information related to the blister card on the lid.

In some aspects, the techniques described herein relate to an automatic blister card packager including: a platen configured to hold a blister card while the blister card is filled with medications; and a sealing assembly configured to simultaneously apply a lid to the filled blister card and print on the lid while the filled blister card is supported by the platen.

DETAILED DESCRIPTION

Before any examples, features, aspects, or embodiments are explained in detail, it is to be understood that the examples, features, aspects, or embodiments are not limited in their application to the details of construction and the arrangement of components set forth in the following description or illustrated in the following drawings. The examples, features, aspects, or embodiments are capable of being practiced or of being carried out in various ways.

Figure 1:
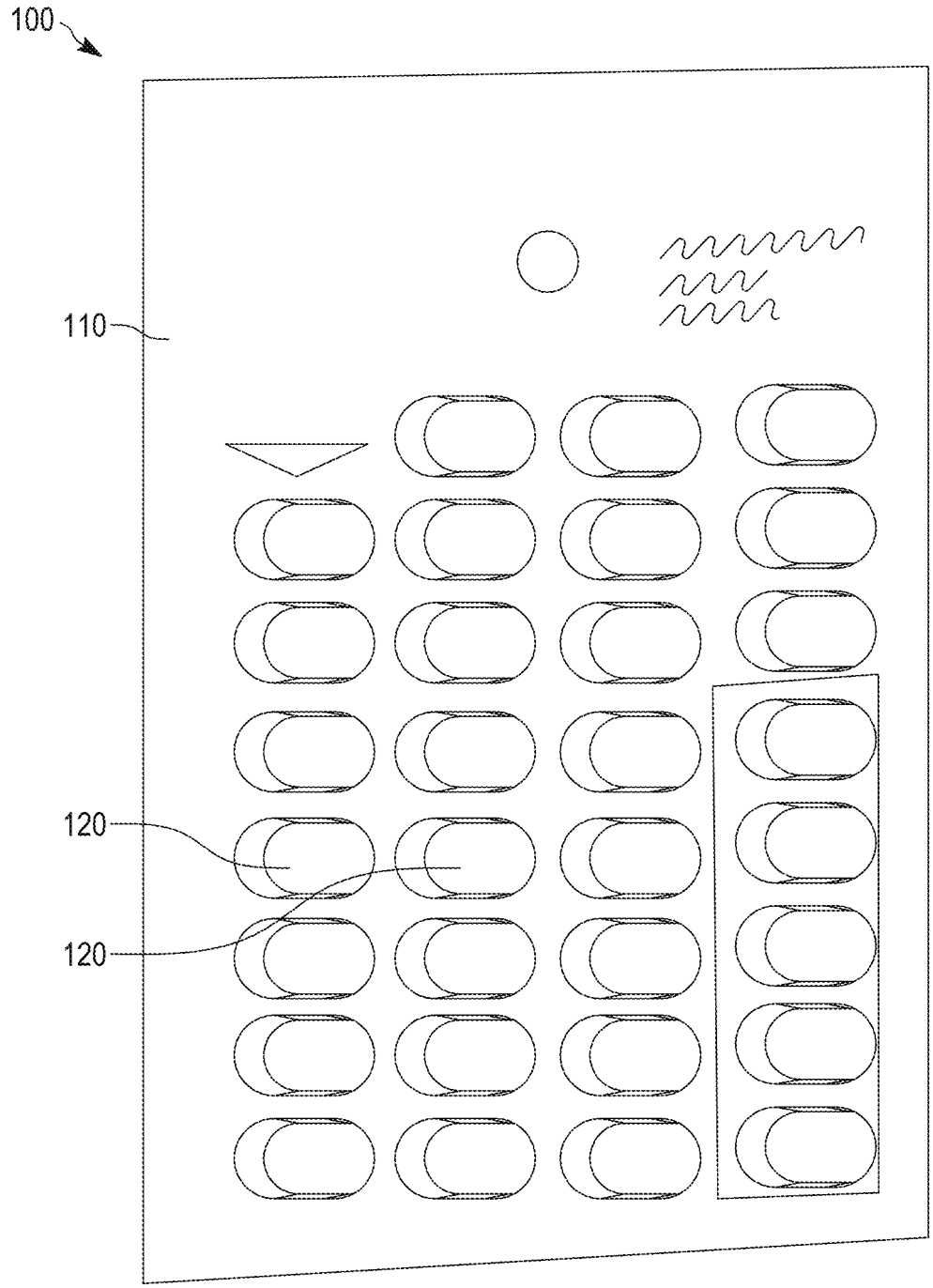
FIG. 1 illustrates a blister card in accordance with some examples.

FIG. 1 illustrates an example of a blister card 100. The blister card 100 includes a blister sheet 110 having a one or more of blister compartments 120, for example, twenty-eight to thirty-two depending on the configuration of the blister card 100. Each blister compartment 120 may receive a single unit of medication (e.g., single-unit blister card) or may receive more than a single unit of medication (e.g., multi-unit blister card). Examples are described below with respect to single-unit blister card filling. However, the features and techniques disclosed herein are equally applicable to multi-unit blister card filling with or without minor modifications. The blister cards 100 are stackable such that the blister compartments 120 of a first blister card 100 above a second blister card 100 fit into the blister compartments 120 of the second blister card.

Figure 2:
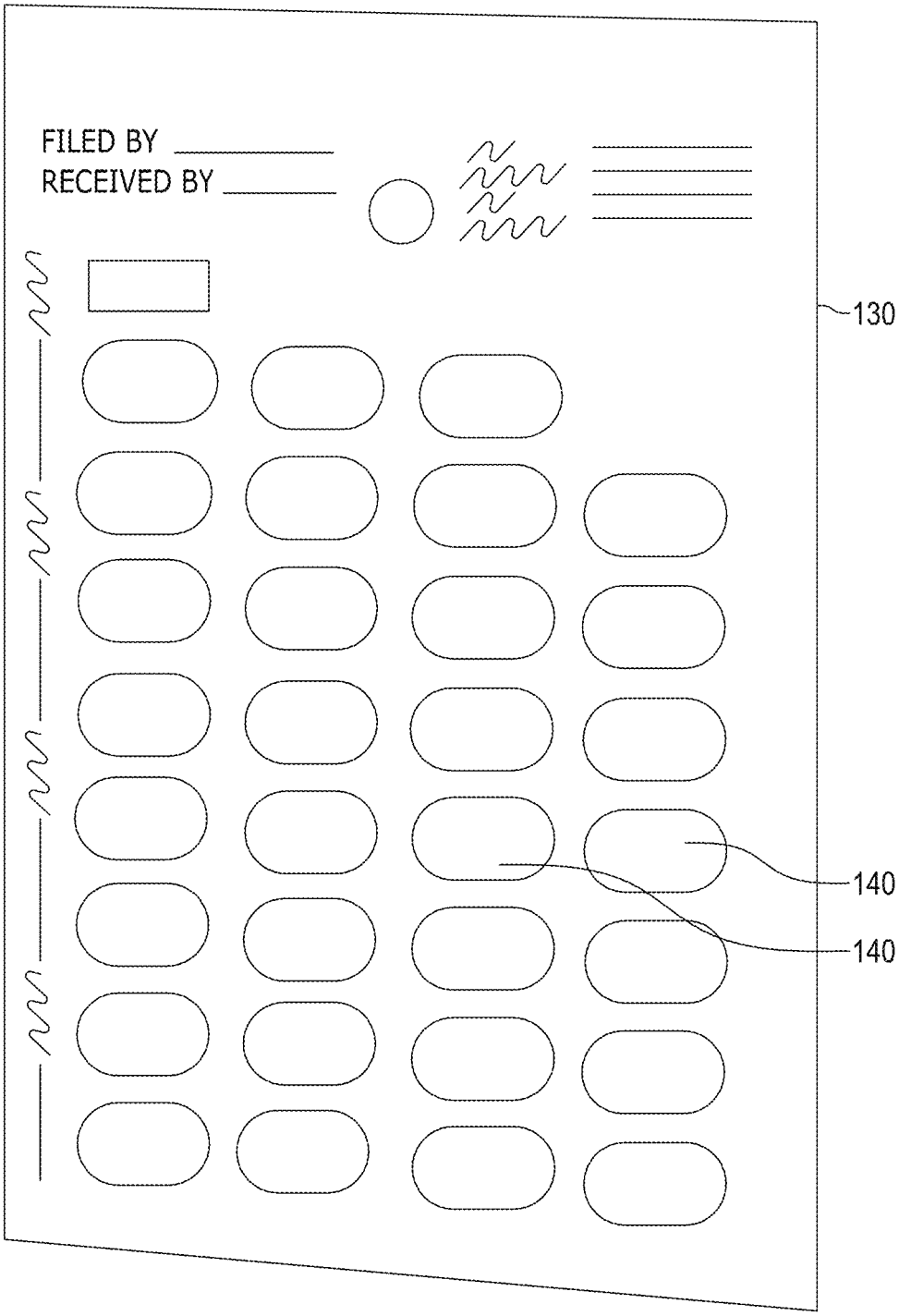
FIG. 2 illustrates a lid for the blister card of FIG. 1 in accordance with some examples.

FIG. 2 illustrates an example lid 130. When the blister compartments 120 are filled, a lid 130 is attached to the back of the blister sheet 110 to seal the blister compartments 120. The lid 130 includes information regarding the blister card 100 including, for example, a facility name, a patient name, a medication name, a medication dose, and the like. The lid 130 includes seal portions 140 aligned with each blister compartment 120 such that a user may tear the seal portions 140 to retrieve the packaged medication. The lid 130 is adhesive-backed such that it will stick and seal the blister sheet 110 when applied to the blister card 100. The lid 130 may be available in a roll. The roll may include a liner on which the lids 130 are provided. The lids 130 (e.g., in the form of sheets) may be peeled from the liner to be applied to the blister cards 100. The lids 130 may be made of flexible cardboard including a multi-layered structure. The multi-layered structure may include a top printable layer and a bottom layer including an adhesive that allows the lid 130 to be stuck onto the blister sheet 110. A middle layer may be provided including a foil or wax paper that forms the seal portions 140 that is exposed through blister-shaped holes in the top layer and the bottom layer. The top printable layer may include pre-printed information, for example, a logo, company name, or identifying information of the pharmacy, healthcare facility, or the like.

In the example illustrated in FIGS. 1-2, the blister card 100 is a standard 6"×9" card. In other examples, the blister card 100 may be other sizes. The blister card 100 may be used for filling different amounts of pills for different periods of time. For example, the blister card 100 may be used for one week of pills (e.g., 7 pills), for up to four weeks or a month of pills (e.g., 28-31 pills), or more. In some examples, the blister card 100 is a "pre-pack" having only one medication in some or all the blister compartments 120. In other examples, the blister card 100 may include more than one pill in the same blister compartment 120 or distributed among the different blister compartments 120. The lid 130 may be cold sealed or hot sealed with the blister sheet 110 after filling. In some examples, identification and prescription information may be printed on the lid 130.

Figure 3A:
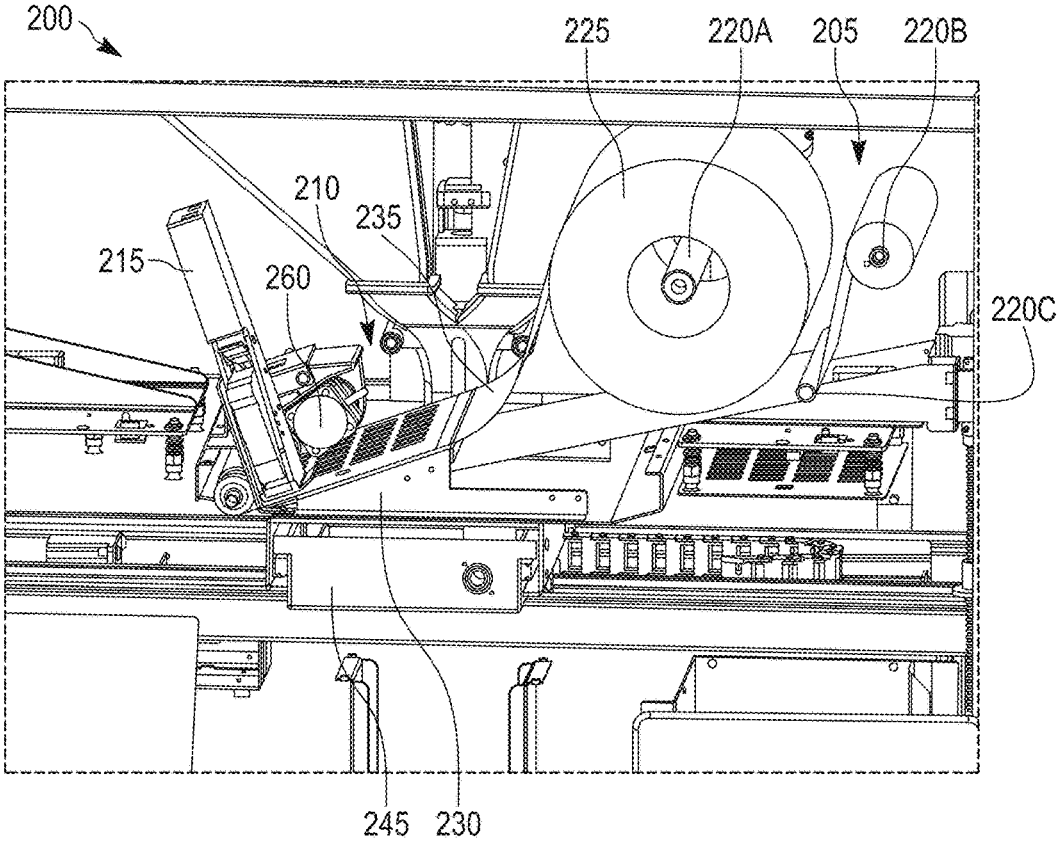
FIG. 3A is a front perspective view of a sealing assembly in accordance with some examples.
Figure 3B:
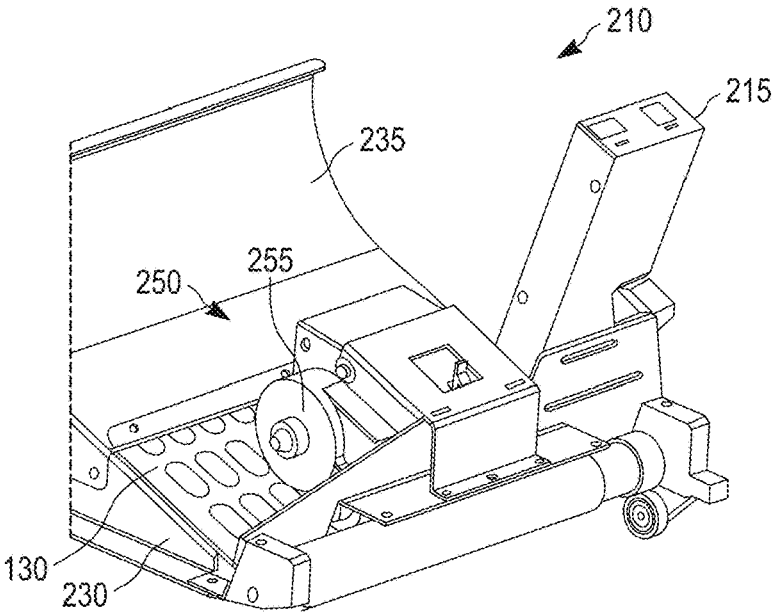
FIG. 3B is a rear perspective view of the sealing assembly of FIG. 3A in accordance with some examples.

Referring to FIGS. 3A-3B, the sealing assembly 200 includes a lid roll holder assembly 205, a guider assembly 210, and a print roller 215. The lid roll holder assembly 205 may include a plurality of holders 220 that support and guide a lid roll 225 through the sealing assembly 200. In the example illustrated, the plurality of holders 220 include a feed holder 220A, a take-up holder 220B, and a guide holder 220C. In some examples, the number or type of holders 220 may differ. The feed holder 220A may be used to hold the unspent lid roll 225 that is fed to the guider assembly 210. The take-up holder 220B may be used to take-up the spent lid roll 225 after the lids 130 are peeled from the lid roll 225. The guide holder 220C may be used to guide the lid roll 225 around the feed holder 220A or the take-up holder 220B.

The guider assembly 210 includes a base 230, a guider 235 fixed to the base 230, and a traction assembly 250 fixed to the base 230. The guider assembly 210 routes or guides the lid 130 from the feed holder 220A to the print roller 215. In the example illustrated, the base 230 includes side portions that may be fixed to a packaging machine (e.g., the automatic blister card packager 500). The base 230 also includes an incline portion that is integrated with the side portions. The incline portion extends downward (i.e., declines) from the guider 235 to the print roller 215 and guides the lid 130 from the feed holder 220A that may be provided above the sealing assembly 200 to the print roller 215. The incline portion includes an edge at a bottom of the incline such that the lid roll 225 is routed around the edge to be returned to the take-up holder 220B. The guider 235 may be fixed at a top of the inclined portion and includes a curved surface that guides lid roll 225 from the feed holder 220A to the base 230 (e.g., the incline portion of the base 230). The guider assembly 210 may include a different structure than described above. For example, either of the base 230 or the guider 235 may be removed or structured differently.

The traction assembly 250 includes a traction roller 255 controlled by a traction motor 260. The lid 130 may be routed between the traction roller 255 and the incline portion of the base 230. The traction roller 255 may be provided near (e.g., adjacent) the bottom edge of the incline portion. The traction roller 255 may include a rubber, silicone, or like surface to create a traction (e.g., gripping) between the traction roller 255 and the lid 130. The traction roller 255 is rotated using the traction motor 260.

The sealing assembly 200 may include a vision system 240 (see FIG. 4), for example, an optical sensor, a camera, or the like that detects an edge of the lid 130. The vision system may be used to line up the lid 130 with a filled blister card 100. In one example, the action of rolling the lid roll 225 around the edge results in a peeling of a lid 130 from the lid roll 225. As the vision system detects the lid 130 lining up with the blister card 100 on the platen 245, the traction motor 260 may be controlled to rotate the traction roller 255 at the same time as the lid roll holder assembly 205 to peel the lid 130 from the lid roll 225. For example, providing a sharp turn using the incline portion and the traction roller 255 gripping the lid 130 (e.g., through traction) may result in a lid 130 being peeled from the lid roll 225 without needing a separate peeler. In other examples, a separate peeler may be used to peel the lid 130 from the lid roll 225. The print roller 215 is provided above and adjacent the guider assembly 210 and applies the lid 130 to the filled blister card 100. In some examples, the print roller 215 may be fixed to the guider assembly 210. The print roller 215 may apply a pressure on the lid 130 to activate the adhesive on the lid 130. The print roller 215 also prints information on the lid 130 at the same time (i.e., simultaneously) as the lid 130 is being applied to the filled blister card 100. For example, the print roller 215 prints information after the lid 130 is started to be applied to the filled blister card 100 but before the lid 130 is completely off the lid roll 225.

The filled blister card 100 may be placed on a platen 245. In one example, the platen 245 is configured to be movable (e.g., using an actuator and rail system) under the sealing assembly 200. In another example, the sealing assembly 200 or a portion of the sealing assembly 200 (e.g., the guider assembly 210 with the print roller 215) is configured to be movable over the platen 245. In yet another example, both the platen 245 and the sealing assembly 200 or a portion of the sealing assembly 200 are configured to be movable as above. The sealing assembly 200 is configured to apply and print on the lid 130 as the platen 245 moves under the sealing assembly 200 (or vice versa).

Figure 4:
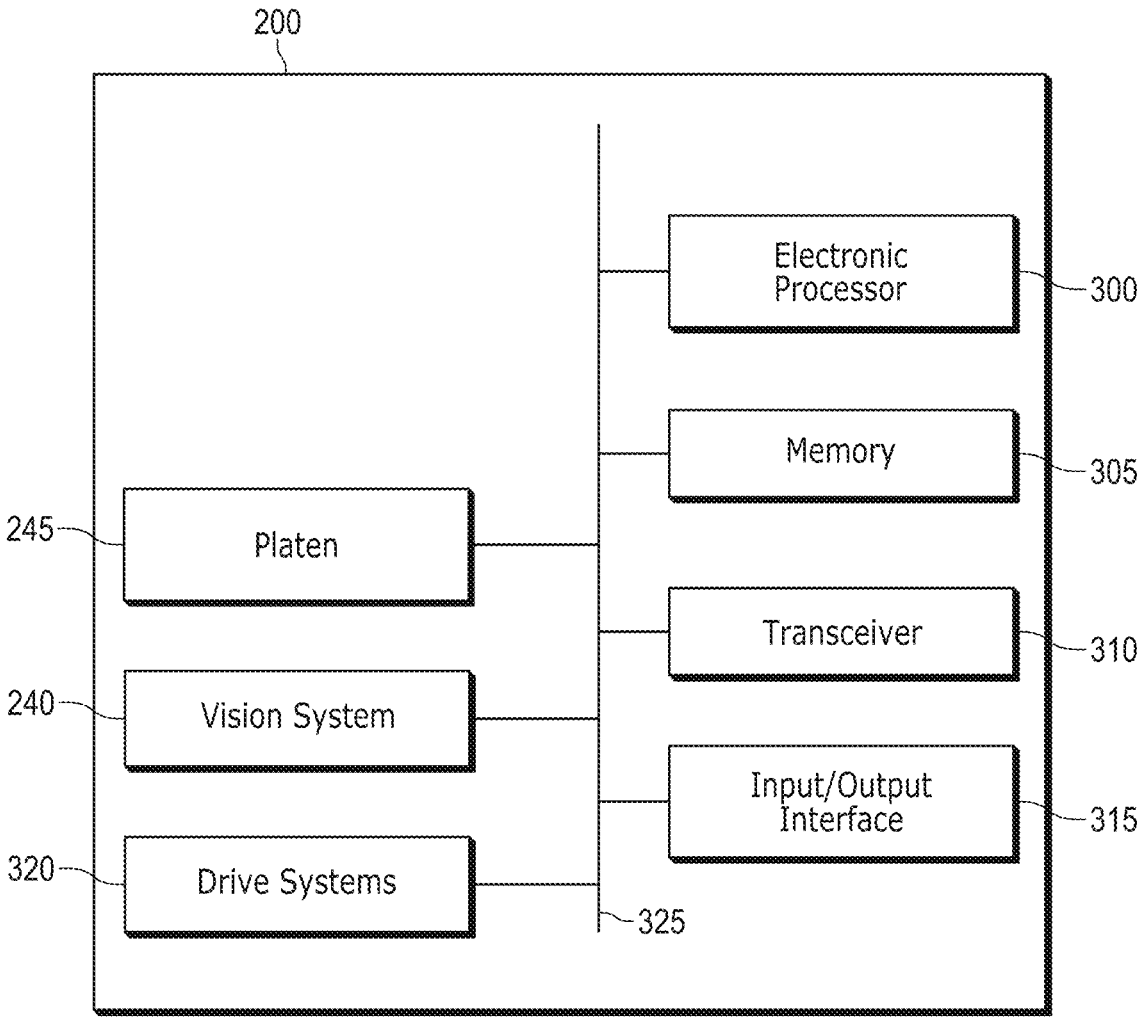
FIG. 4 is a block diagram of the sealing assembly of FIGS. 3A-3B in accordance with some examples.

FIG. 4 is a block diagram of the sealing assembly 200. In the example illustrated, the sealing assembly 200 includes an electronic processor 300, a memory 305, a transceiver 310, and input/output interface 315, drive systems 320, the vision system 240, the print roller 215. The electronic processor 300, the memory 305, the transceiver 310, the input/output interface 315, the platen 245, the vision system 240, and the print roller 215 communicate over one or more control and/or data buses (e.g., a communication bus 325). The sealing assembly 200 may include more or fewer components than those illustrated in FIG. 4.

In some examples, the electronic processor 300 is implemented as a microprocessor with separate memory, such as the memory 305. In other examples, the electronic processor 300 may be implemented as a microcontroller (with the memory 305 on the same chip). In other examples, the electronic processor 300 may be implemented using multiple processors. In addition, the electronic processor 300 may be implemented partially or entirely as, for example, a field-programmable gate array (FPGA), an applications specific integrated circuit (ASIC), and the like, and the memory 305 may not be needed or be modified accordingly. In the example illustrated, the memory 305 includes non-transitory, computer-readable memory that stores instructions that are received and executed by the electronic processor 300 to carry out the functionality of the sealing assembly 200 described herein. The memory 305 may include, for example, a program storage area and a data storage area. The program storage area and the data storage area may include combinations of different types of memory, such as read-only memory and random-access memory.

The transceiver 310 enables wired or wireless communication between the sealing assembly 200 and other devices over one or more communication networks. In other examples, the transceiver 310 may include separate transmitting and receiving components, for example, a transmitter and a receiver.

The input/output interface 315 may include one or more input mechanisms (e.g., a touch screen, a keypad, a button, a knob, and the like), one or more output mechanisms (e.g., a display, a printer, a speaker, and the like), or a combination thereof. The input/output interface 315 receives input from the input devices actuated by a user and provides output to the output devices with which a user interacts. In one example, the input/output interface 315 includes a display configured to display images captured and processed by the sealing assembly 200.

The drive systems 320 include, for example, one or more actuators (e.g., motors) to drive the platen 245, the lid roll holder assembly 205, the print roller 215, and/or the traction motor 260. The drive systems 320 may include a separate electronic processor and memory for controlling the motors, solenoids, etc.

Figure 5:
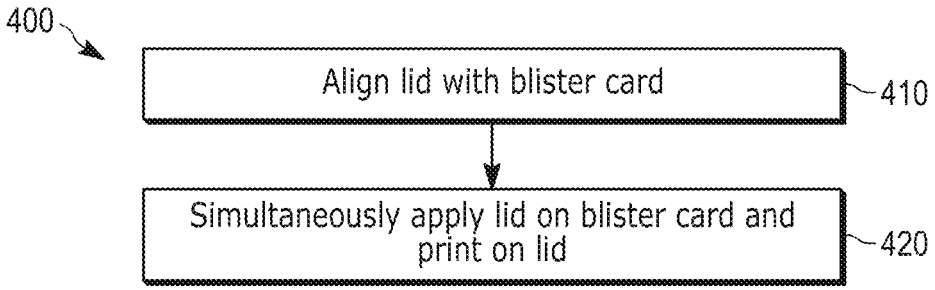
FIG. 5 is a flowchart of an example method for sealing a blister card using the sealing system of FIGS. 3A-3B in accordance with some examples.

FIG. 5 is a flowchart illustrating one example method 400 for sealing a blister card 100 using the sealing assembly 200. As illustrated in FIG. 5, the method 400 includes aligning, using the vision system 240 of the sealing assembly 200, a lid 130 with the blister card 100 (at block 410). The electronic processor 300 uses the vision system 240 of the sealing assembly 200 to determine whether the lid 130 is aligned with the blister card 100 on the platen 245. The electronic processor 300 controls the platen 245 and/or the lid roll holder assembly 205 to align the lid 130 just above the blister card 100 on the platen 245.

The method 400 includes simultaneously applying the lid 130 on the blister card 100 and labeling on the lid 130 (at block 420). The electronic processor 300 controls the lid roll holder assembly 205 to dispense the lid 130 onto the blister card 100 on the platen 245. Simultaneously, the electronic processor 300 controls the platen 245 to move right to left as the lid 130 is being dispensed to apply the lid 130 to the blister card 100 on the platen 245. In some examples, the platen 245 may stay stationary while the lid roll holder assembly 205 is moved to the right to apply the lid 130 to the blister card 100 on the platen 245. The print roller 215 prints the label information, for example, patient name, facility name, medication information (e.g., name, dosage, etc.), dosage information, and/or the like on the lid 130. The print roller 215 may also apply pressure and/or heat to the lid 130 to activate the adhesive on the lid 130. In some examples, rather than printing on the fly, a pre-printed sheet may be adhesively applied to the lid 130 simultaneously as the lid 130 is being applied to the blister card 100.

Figure 6:
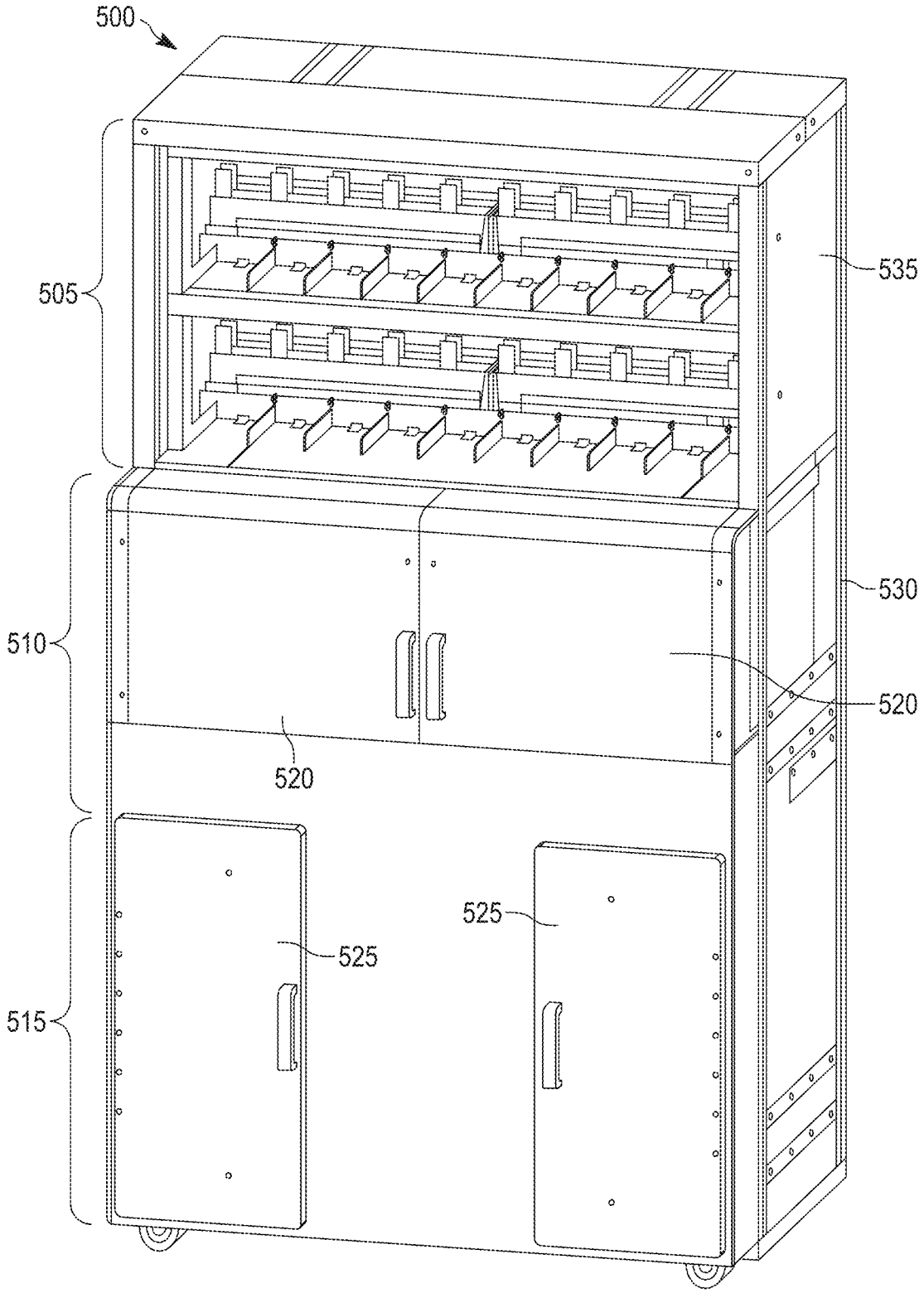
FIG. 6 is a perspective view of an automatic blister card packager including the sealing system of FIGS. 3A-3B in accordance with some examples.
Figure 7:
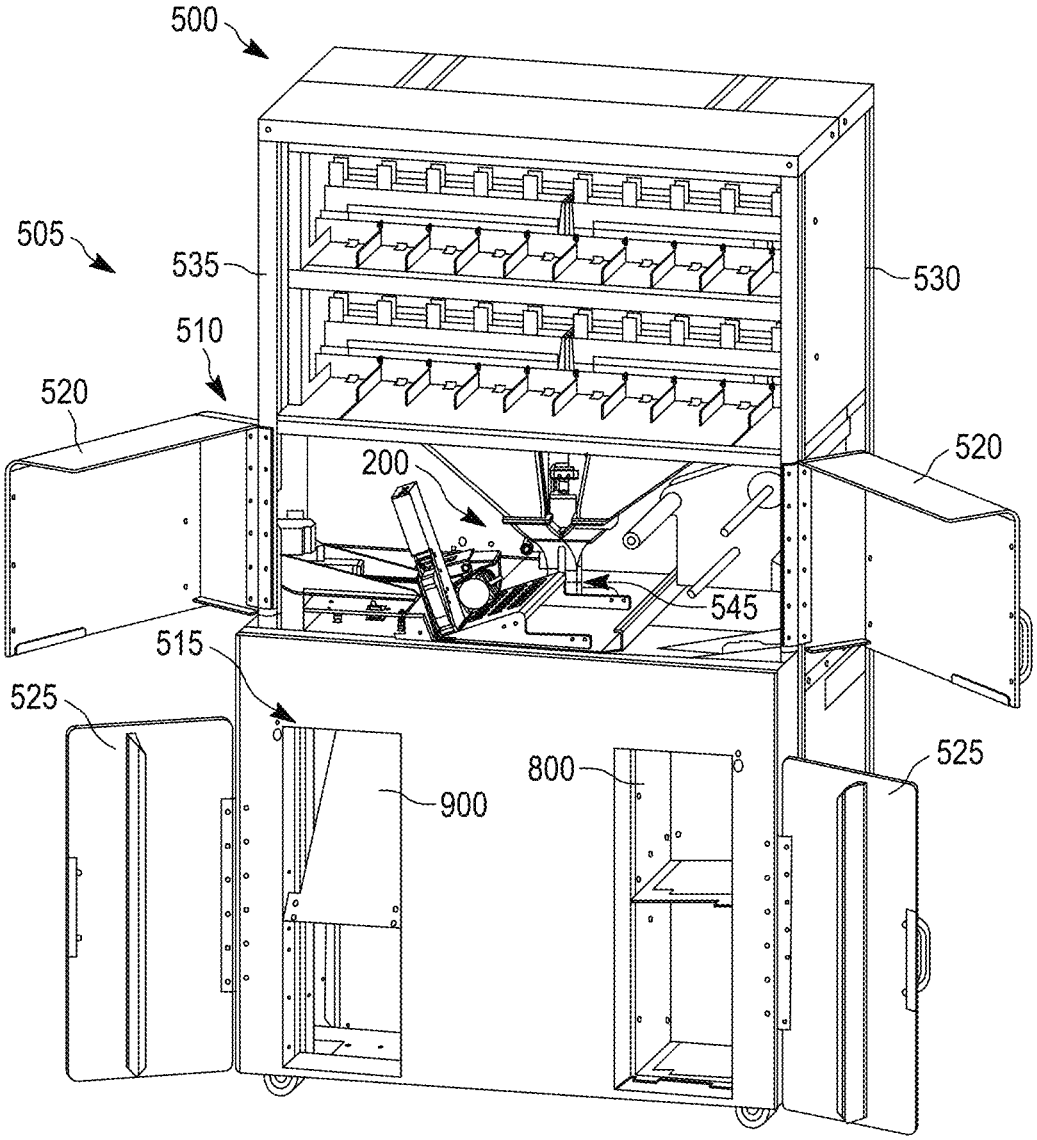
FIG. 7 is a perspective view of the automatic blister card packager of FIG. 6 with doors opened in accordance with some examples.

The sealing assembly 200 may be implemented in a blister card packaging machine or may be operated independently to seal blister cards filled manually or using a blister card packaging machine. FIGS. 6-7 illustrate an example of an automatic blister card packager 500 that includes the sealing assembly 200. In the example illustrated, the automatic blister card packager 500 is divided into a cartridge section 505, a packaging section 510, and a card transfer section 515. The cartridge section 505 is provided above the packaging section 510 to dispense pharmaceuticals to the packaging section 510. The packaging section 510 is provided above the card transfer section 515 and may overlap the card transfer section 515. The cartridge section 505 is provided above the card transfer section 515. In other examples, the location or arrangement of the cartridge section 505, the packaging section 510, and the card transfer section 515 may vary.

In one example, the cartridge section 505 is open while packaging section doors 520 are provided for the packaging section 510 and card transfer doors 525 are provided for the card transfer section 515. The packaging section doors 520 open outwards to expose at least portions of the packaging section 510. The packaging section doors 520 may be closed during operation to inhibit contaminants from getting into the blister card 100. The packaging section doors 520 may be opened to allow for a user or technician to clean or inspect the packaging section 510. The card transfer doors 525 may similarly open outwards to expose at least portions of the card transfer section 515. In some examples, a single door may be provided to access one or more of the cartridge section 505, the packaging section 510, and the card transfer section 515. In other examples, each of the cartridge section 505, the packaging section 510, and the card transfer section 515 may be open without any doors for selective access.

The cartridge section 505, the packaging section 510, and the card transfer section 515 may together form the frame or housing 530 of the automatic blister card packager 500 to which the various components disclosed herein are mounted on or housed in. The frame or housing 530 may be made of rigid material, for example, metal, carbon fiber, or the like to provide support for the various components.

The cartridge section 505 includes a universal feed cassette 535 supported by the frame or housing 530. The universal feed cassette 535 receives medications from the bulk canisters and individually dispenses medications to the packaging section 510. The medications dispensed from the universal feed cassette 535 are received at the packaging section 510 via a chute 540 (see FIGS. 8-9). The chute 540 may be provided in the packaging section 510 of the automatic blister card packager 500. The sealing assembly 200 may be provided in the packaging section 510 in front of the chute 540.

Figure 8:
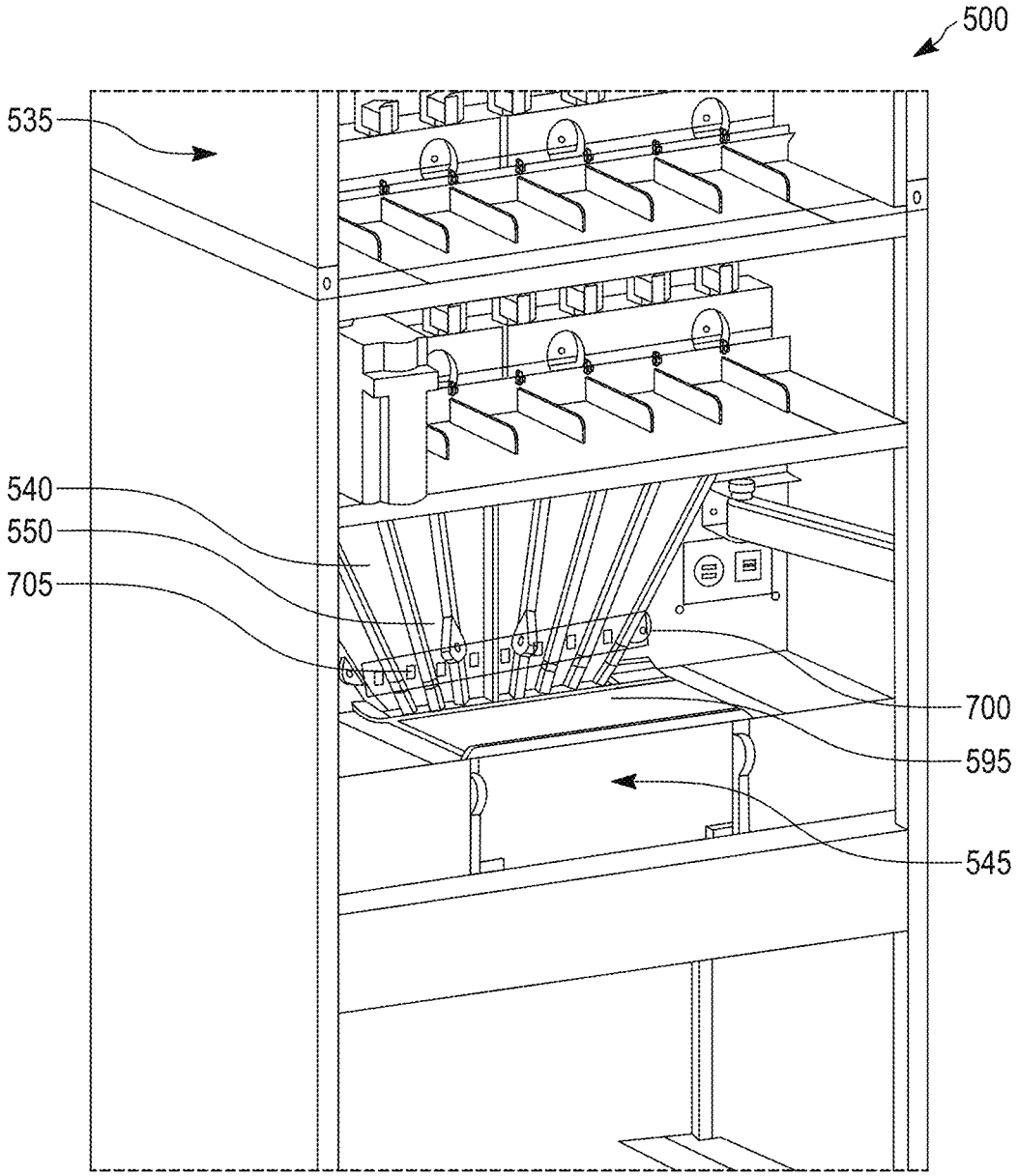
FIG. 8 is an enlarged view of a portion of the automatic blister card packager of FIG. 6 in accordance with some examples.

FIG. 8 illustrates one example of the chute 540 for use with the automatic blister card packager 500. The chute 540 helps direct pharmaceuticals (e.g., pills, vitamins, etc.) from the universal feed cassette 535 to a filling station 545 provided in the packaging section 510. In the illustrated example, the chute 540 includes eight separate channels or tracks 550. The number of tracks 550 correspond to a number of cartridge slots or cartridges of the universal feed cassette 535. As such, in some examples, the chute 540 may include fewer or more tracks 550. Each track 550 has a separate outlet that corresponds to one of the blister compartments 120 of the blister card 100 in the platen 245. When pharmaceuticals are delivered from the universal feed cassette 535, the pharmaceuticals travel through the tracks 550, through the outlets, and into the platen 245.

Figure 9:
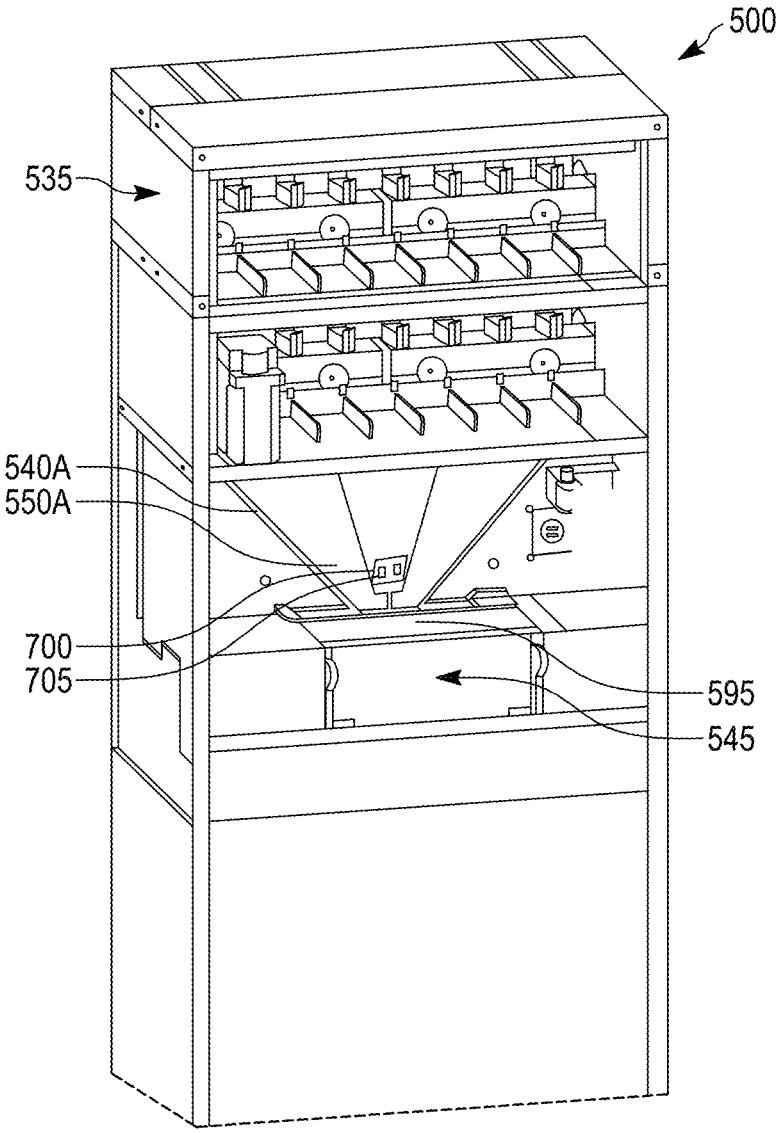
FIG. 9 is a perspective view of the automatic blister card packager of FIG. 6 in accordance with some examples.

FIG. 9 illustrates another example of a chute 540A for use with the automatic blister card packager 500. In the illustrated example, the chute 540A includes two shared channels or tracks 550A that dispense pharmaceuticals through shared outlets to the platen 245. In other examples, the chute 540A may include a single shared track or channel that dispenses pharmaceuticals through a single outlet. The illustrated example of the chute 540A, therefore, can only direct pharmaceuticals to two blister compartments 120 of the blister card 100 in the platen 245 at a time. The platen 245, however, can move side-to-side to align with different blister compartments 120 in a row of blister compartments 120 with the shared outlets of the chute 540A. Hereinafter, chute 540 may refer to either of the configurations illustrated in FIGS. 8 and 9 or other similar configurations.

Figure 10:
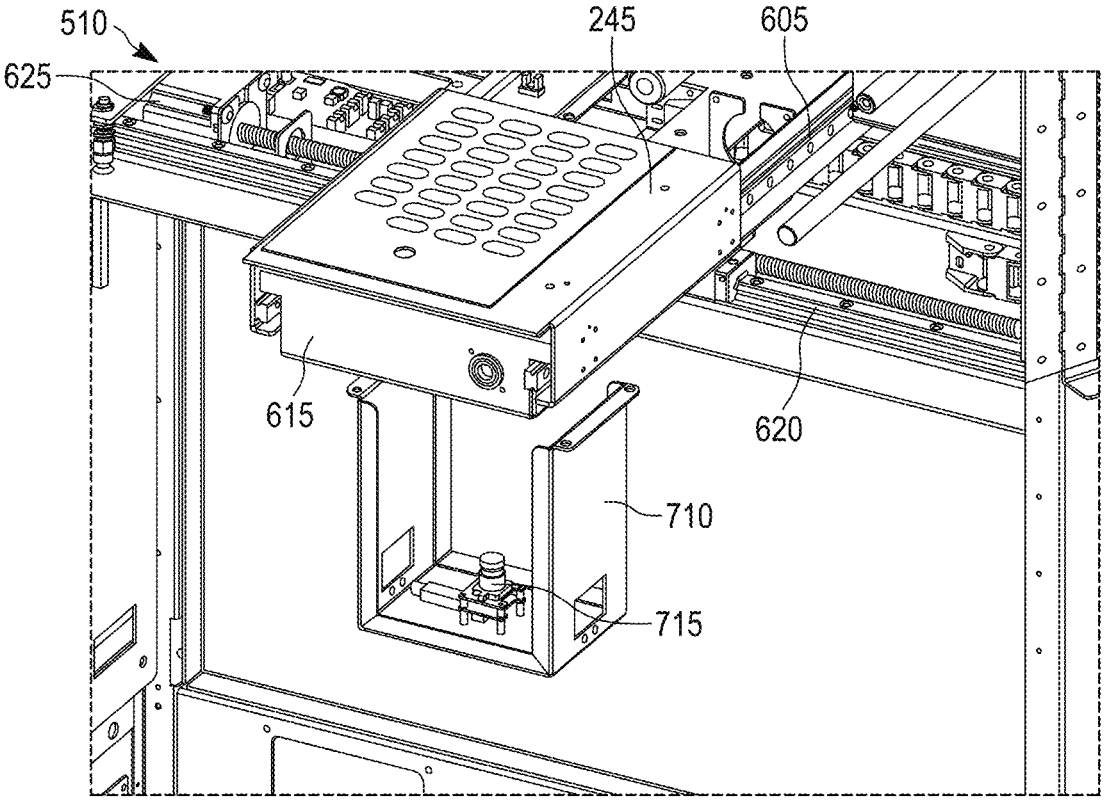
FIG. 10 is an enlarged view of a portion of the automatic blister card packager of FIG. 6 showing a platen in accordance with some examples.

Referring to FIG. 8-9, the packaging section 510 includes a filling station 545 to package the medications dispensed from the universal feed cassette 535 into the blister card 100. The filling station 545 refers to the area near the bottom of the chute 540 where the medications are delivered to be packaged into the blister card 100. Referring to FIG. 10, the packaging section 510 includes a first rail system 605 and the platen 245. The first rail system 605 includes a first rail drive 615 and moves the platen 245 along a first axis of the automatic blister card packager 500 (e.g., a front-back axis). The first rail system 605 telescopes the platen 245 along the length of the filling station 545. The first rail drive 615 may be a motor assembly, an actuator, or the like that drives the platen 245 using the first rail system 605. In other examples, a different moving system may be used to translate the platen 245 along the length of the filling station 545.

The packaging section 510 also includes a second rail system 620. The second rail system 620 includes a second rail drive 625 and moves the platen 245 and the first rail system 605 along a second axis of the automatic blister card packager 500. The second rail system 620 and the second rail drive 625 may work similarly as the first rail system 605 and the first rail drive 615 to move the platen 245 and the first rail system 605 along a second axis (e.g., a left-right axis). Alternatively, in some examples, the second rail system 620 moves the platen 245 and the first rail system 605 drives the platen 245 and the second rail system 620. In yet other examples, different drive configurations may be used to move the platen 245 within the automatic blister card packager 500.

Figure 11:
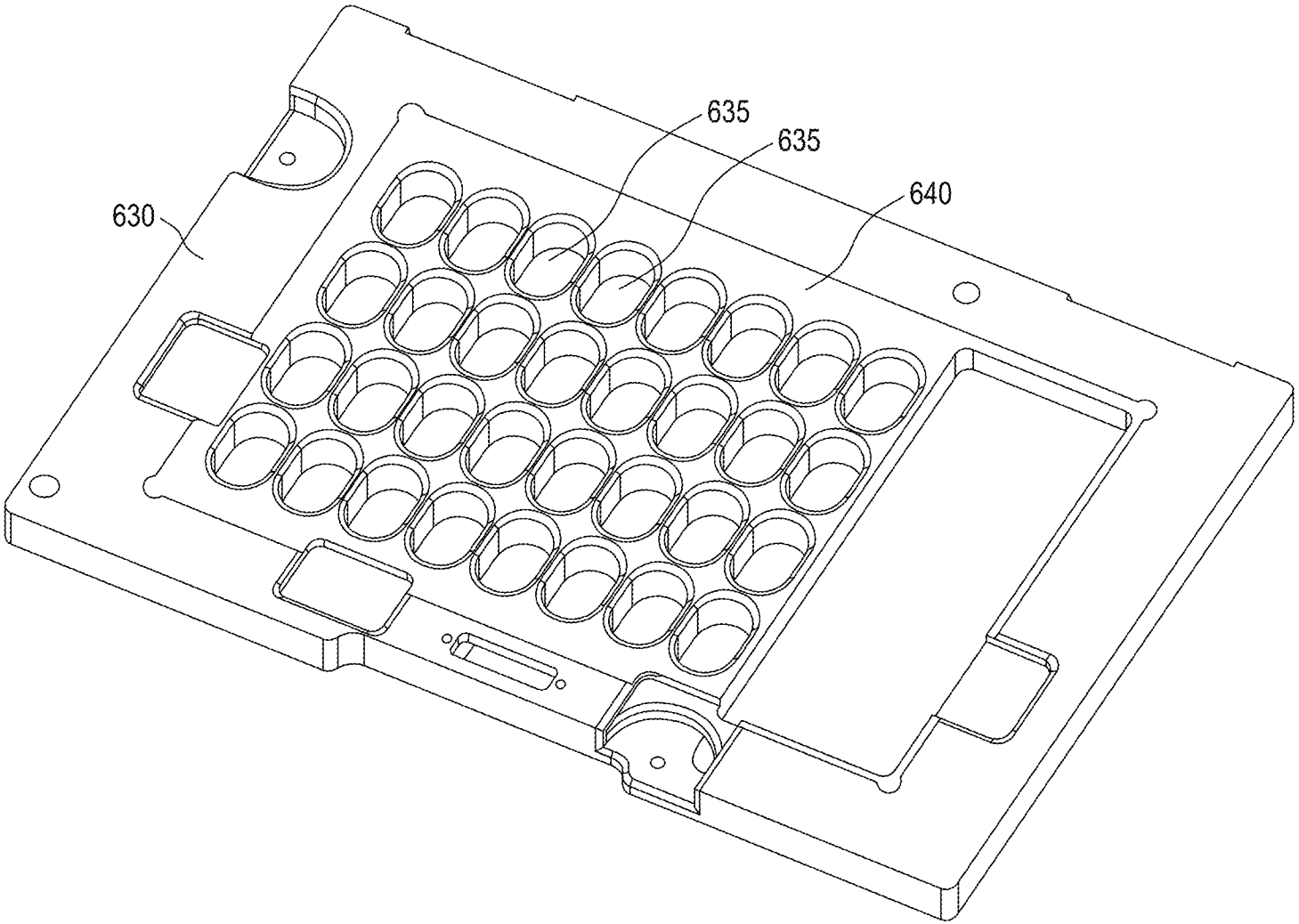
FIG. 11 is a perspective view of a packaging plate of the platen of FIG. 10 in accordance with some examples.

Referring to FIG. 11, the platen 245 includes a packaging plate 630. The packaging plate 630 includes blister openings 635 provided in a blister card receiving portion 640. The blister openings 635 accommodate the blister compartments 120 of the blister sheet 110. In the example illustrated, the blister openings 635 are through-holes that extend through the packaging plate 630.

Referring to FIGS. 8-9, a filling cover 595 may be attached to the outlets of the chute 540, in some example implementations. The filling cover 595 covers one or more of the blister compartments 120 that are not directly under the outlets of the chute 540. For example, the filling cover 595 may include a number of openings corresponding to the outlets of the chute 540 to allow the medications to pass through from the chute 540 to the blister compartments 120 under the outlets of the chute 540. The filling cover 595 prevents medications from hopping from one blister compartment 120 to another during the filling process by providing a barrier between the blister compartments 120 being filled and the remaining blister compartments 120. In one example, the filling cover 595 is dimensioned larger than the size of the blister card 100 to account for the X-Y axis movement of the platen 245 (e.g., two times larger to cover only X-axis or only Y-axis movement, four times larger to cover both X-Y axis movement, or the like). In one example, the filling cover 595 is dimensioned to be the same size or smaller than the blister card 100. For example, the filling cover 595 may extend to only one side, e.g., towards a side of movement of the platen 245 along an X-axis or Y-axis.

Referring to FIG. 8, a first verification camera system 700 may be placed near the chute 540. The first verification camera system 700 may include a plurality of first verification cameras 705 placed near the junction of the chute 540 and the platen 245. The plurality of first verification cameras 705 can include one first verification camera 705 for each track of the chute 540. The first verification camera 705 for each track may be placed just above the junction of the chute 540 and the platen 245. The first verification camera 705 for each track is configured to capture an image of the blister compartment 120 corresponding to the track from above the blister compartment 120. For example, the first verification cameras 705 may be configured to capture an image of the blister compartment 120 looking through the openings in the filling cover 595. The first verification camera 705 may capture the images before and/or after one or more pills are released into the blister compartment 120. In some examples, the first verification camera system 700 and the corresponding plurality of first verification cameras 705 may be placed in other locations. In one example, the tracks of the chute 540 may curve backward toward the bottom end of the chute 540 to direct the medications into the blister compartments 120. The first verification camera system 700 may be provided just above the curved portion and behind the chute 540 such that the plurality of first verification cameras 705 have a view of the of the blister compartments 120 through the curved portions of the track. In some examples, the first verification camera system 700 may include more or fewer first verification cameras 705 than the number of tracks in the chute 540. In these examples, the first verification cameras 705 or the platen 245 may be moved to capture the images from above the blister compartments 120.

Referring to FIG. 9, the first verification camera system 700 may be placed near the chute 540A. In this example, the first verification camera system 700 may include two first verification cameras 705, one for each track 550A of the chute 540A. Alternatively, the first verification camera system 700 may include a single verification camera that has visibility to both tracks 550A. The tracks 550A include a curve near the bottom end of the chute 540A. The tracks 550A curve inward from the chute 540A. The first verification cameras 705 are placed near the junction of the chute 540A and the platen 245 and just above the curved portion of the tracks 550A such that the first verification cameras 705 have a view of the blister compartments 120 through the curved portions of the tracks 550A. The first verification cameras 705 are configured to capture an image of the blister compartment 120 corresponding to the track 550A from above the blister compartment 120. For example, the first verification cameras 705 may be configured to capture an image of the blister compartment 120 looking through the openings in the filling cover 595. The first verification cameras 705 may capture the images before and/or after one or more pills are released into the blister compartment 120. In some examples, the first verification camera system 700 and the corresponding plurality of first verification cameras 705 may be placed in other locations.

Referring to FIG. 10, a second verification camera system 710 may be placed in the automatic blister card packager 500 under the platen 245. The second verification camera system 710 may include one or more second verification cameras 715 configured to capture images of the blister compartments 120 from under the platen 245. The first verification camera system 700 and the second verification camera system 710 are therefore configured to capture images of the blister compartments 120 from the top and the bottom of the blister card 100 during and/or after filling of the blister card 100. In some examples, the second verification camera system 710 and the corresponding one or more second verification cameras 715 may be placed in other locations, for example, on an opposite side of platen 245.

In some examples, the first verification camera system 700 and the second verification camera system 710 may also include integrated lights (e.g., flashlights) to illuminate the blister compartments 120 when the images are taken. These lights may be activated when the cameras 705, 715 are capturing images of the blister compartments 120. In some examples, the first verification camera system 700 is configured to capture images of individual blister compartments 120 from above during filling, whereas the second verification camera system 710 is configured to capture an image of the filled blister card 100 as a whole from below after filling. In other examples, both the first verification camera system 700 and the second verification camera system 710 are configured to capture images of individual blister compartments 120, from above and below respectively, during filling. In still other examples, both the first verification camera system 700 and the second verification camera system 710 are configured to capture images of the blister card 100 as a whole from above and below. In still other examples, both the first verification camera system 700 and the second verification camera system 710 are configured to capture images of portions (for example, rows or columns) of the blister card 100 from above and below.

Referring to FIG. 7, the card transfer section 515 includes a loading station 800 and a discharging station 900. In the example illustrated, the loading station 800 is provided on a first side of the frame or housing 530 and the discharging station 900 is provided on a second side of the frame or housing 530. The second side is opposite the first side on the frame or housing 530. The loading station 800 and the discharging station 900 are provided partially or completely below the filling station 545.

Figure 13:
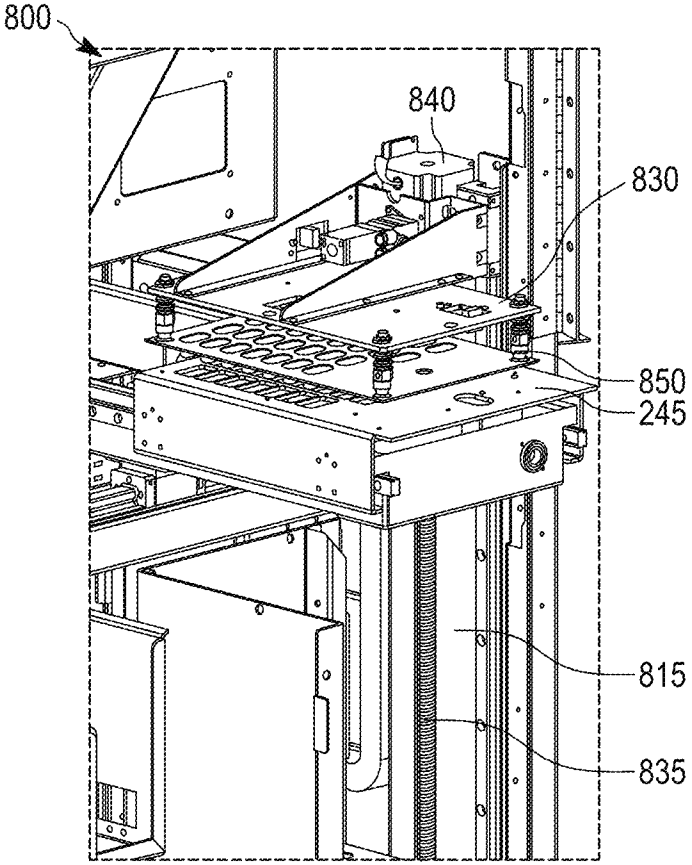
FIG. 13 is an enlarged view of a portion of the automatic blister card packager of FIG. 6 showing the loading station of FIG. 12 in accordance with some examples.
Figure 12:
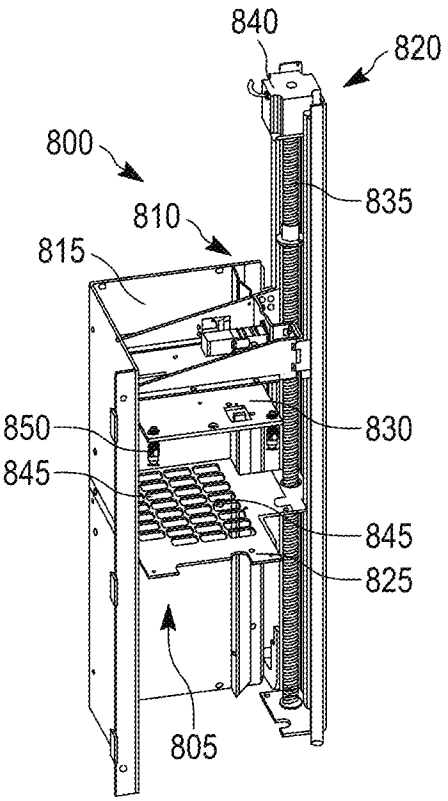
FIG. 12 is a perspective view of a loading station of the automatic blister card packager of FIG. 6 in accordance with some examples.

Referring to FIGS. 12-13, the loading station 800 includes a loading enclosure 805 and a card loading assembly 810 in the loading enclosure 805. In the example illustrated, card loading assembly 810 includes a loader frame 815, a loader drive assembly 820, a card plate 825, and a loader plate 830. In the example illustrated, the loader frame 815 may be mounted to the frame or housing 530 or may be a part of the frame of housing 530. The loader drive assembly 820 is mounted to the loader frame 815. In the example illustrated, the loader drive assembly 820 includes a screw 835 driven by, for example, a motor 840. In other examples, the loader drive assembly 820 (e.g., base actuator) may include a different type of driving mechanism, for example, telescoping rails, or the like. In one example, the card plate 825 (base) is mounted to the screw 835 such that the card plate 825 moves along the screw 835 (e.g., track) as the screw 835 is driven by the motor 840. In another example, the card plate 825 is stationary and only the loader plate 830 is moved. In other example, the card plate 825 may have a different configuration other than a plate and moves along a different track other than the screw (e.g., moves along rails). The card plate 825 is configured to receive a stack of blister cards 100 (e.g., a plurality of blister cards 100) and may include openings 845 to accommodate the blister compartment 120. One of the card transfer doors 525 may be used to cover the loading enclosure 805 during operation.

The loader plate 830 (e.g., a loader suction plate, a loader, etc.) is mounted to the screw 835 such that the loader plate 830 moves along the screw 835 (e.g., track) as the screw 835 is driven by the motor 840. The loader plate 830 may be driven to move along the loader frame 815 or the screw 835 along the same axis as the card plate 825. In one example, the loader plate 830 is driven by the loader drive assembly 820 (e.g., loader actuator). In another example, the loader plate 830 is driven by a separate drive assembly (e.g., loader actuator). The loader plate 830 includes one or more nozzles 850 that generate a suction force to grab a blister card 100 from the stack of the blister cards 100. The one or more nozzles 850 may also generate a positive pressure to push the blister card 100 from the loader plate 830. Positive pressure may refer to the opposite of suction force (that is, force generated in the opposite direction) generated by the suction system to, for example, blow air out of the one or more nozzles 850. In other examples, the loader plate 830 may have a different configuration other than a plate. Additionally or alternatively, in another example, the loader plate 830 may grab a blister card 100 from the stack of blister cards 100 using other suitable mechanisms, such as fingers, hooks, adhesives, magnets, static electricity, and the like. In such scenarios, the blister cards 100 may include appropriate features to interact with and be engaged by the loader plate 830.

Figure 15:
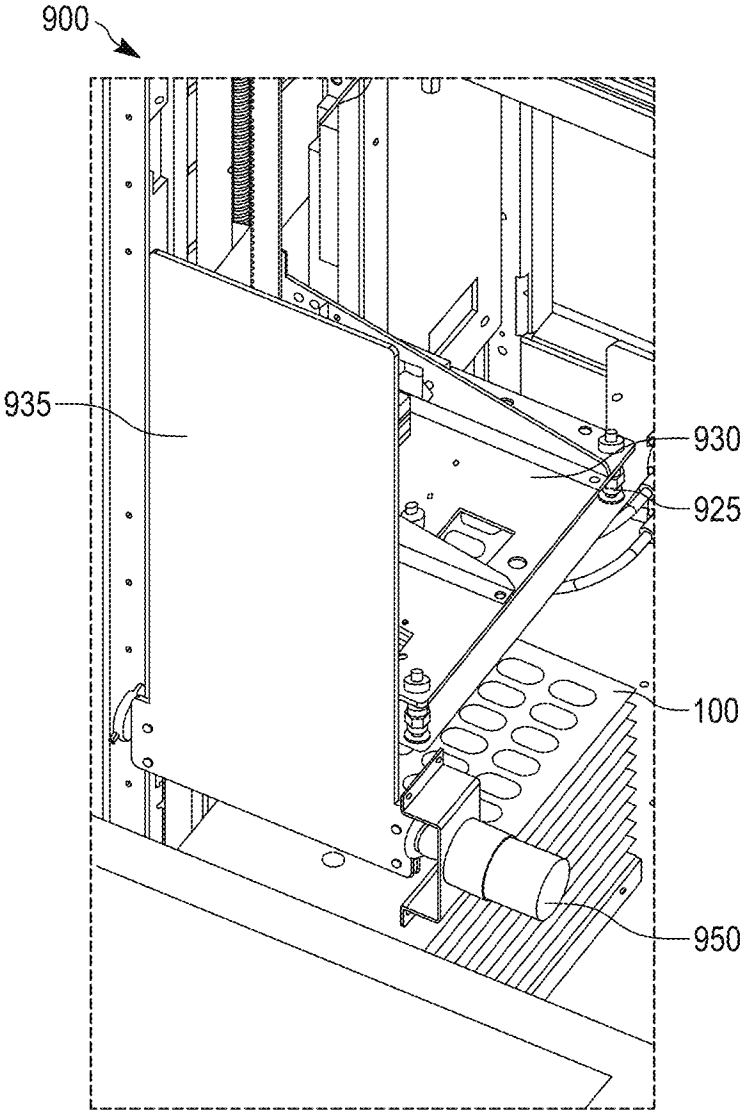
FIG. 15 is an enlarged view of a portion of the automatic blister card packager of FIG. 6 showing a discharging station in accordance with some examples.
Figure 14:
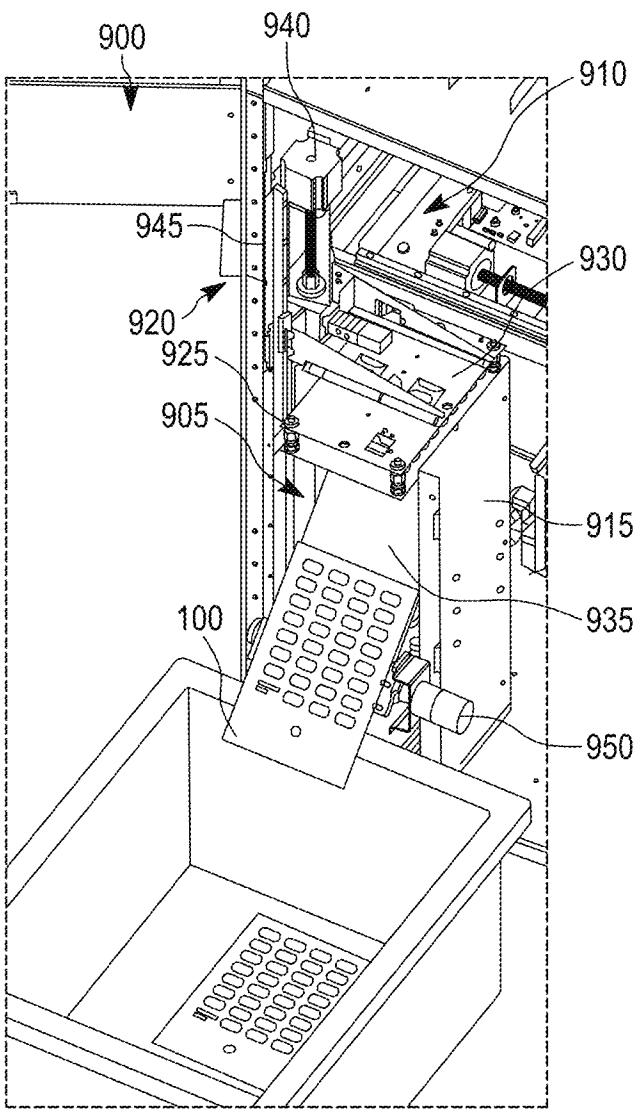
FIG. 14 is an enlarged view of a portion of the automatic blister card packager of FIG. 6 showing a discharging station in accordance with some examples.

Referring to FIGS. 14-15, the discharging station 900 includes a discharging enclosure 905 and a card discharging assembly 910 in the discharging enclosure 905. The card discharging assembly 910 includes a discharging frame 915, a discharger drive assembly 920, a discharger plate 930, and a deflector 935. In the example illustrated, the discharging frame 915 may be mounted to the frame or housing 530 or may be a part of the frame of housing 530. The discharger drive assembly 920 is mounted to the discharging frame 915. In the example illustrated, the discharger drive assembly 920 includes a screw 945 driven by, for example, a motor 940. In other examples, the discharger drive assembly 920 may include a different type of driving mechanism, for example, telescoping rails, or the like.

The discharger plate 930 (e.g., discharger) is mounted to the screw 945. The discharger plate 930 may also be driven to move along the discharging frame 915 or the screw 945. The discharger plate 930 may be driven by the discharger drive assembly 920 along the screw 945. The discharger plate 930 includes one or more nozzles 925 that generate a suction force to grab a blister card 100 from the platen 245. The one or more nozzles 925 (that is, the suction system through the one or more nozzles 925) may also generate a positive pressure to push the blister card 100 from the discharger plate 930. In other examples, the discharger plate 930 may have a different configuration other than a plate. Additionally or alternatively, in another example, the discharger plate 930 may grab a bister card 100 from the platen 245 using other suitable mechanisms, such as fingers, hooks, adhesives, magnets, static electricity, and the like. The deflector 935 is pivotably fixed to the frame or housing 530 and is pivoted by, for example, a deflector motor 950. The deflector motor 950 pivots the deflector 935 between a first position (shown in FIG. 14) and a second position (shown in FIG. 15). When in the first position as shown in FIG. 15, the deflector 935 extends into the discharging enclosure 905 to block the path of a filled blister card 100 when released from the discharger plate 930. When in the second position as shown in FIG. 15, the deflector 935 is out of the discharging enclosure 905 such that a filled blister card 100 when released from the discharger plate 930 falls straight down in the discharging enclosure 905.

Figure 16:
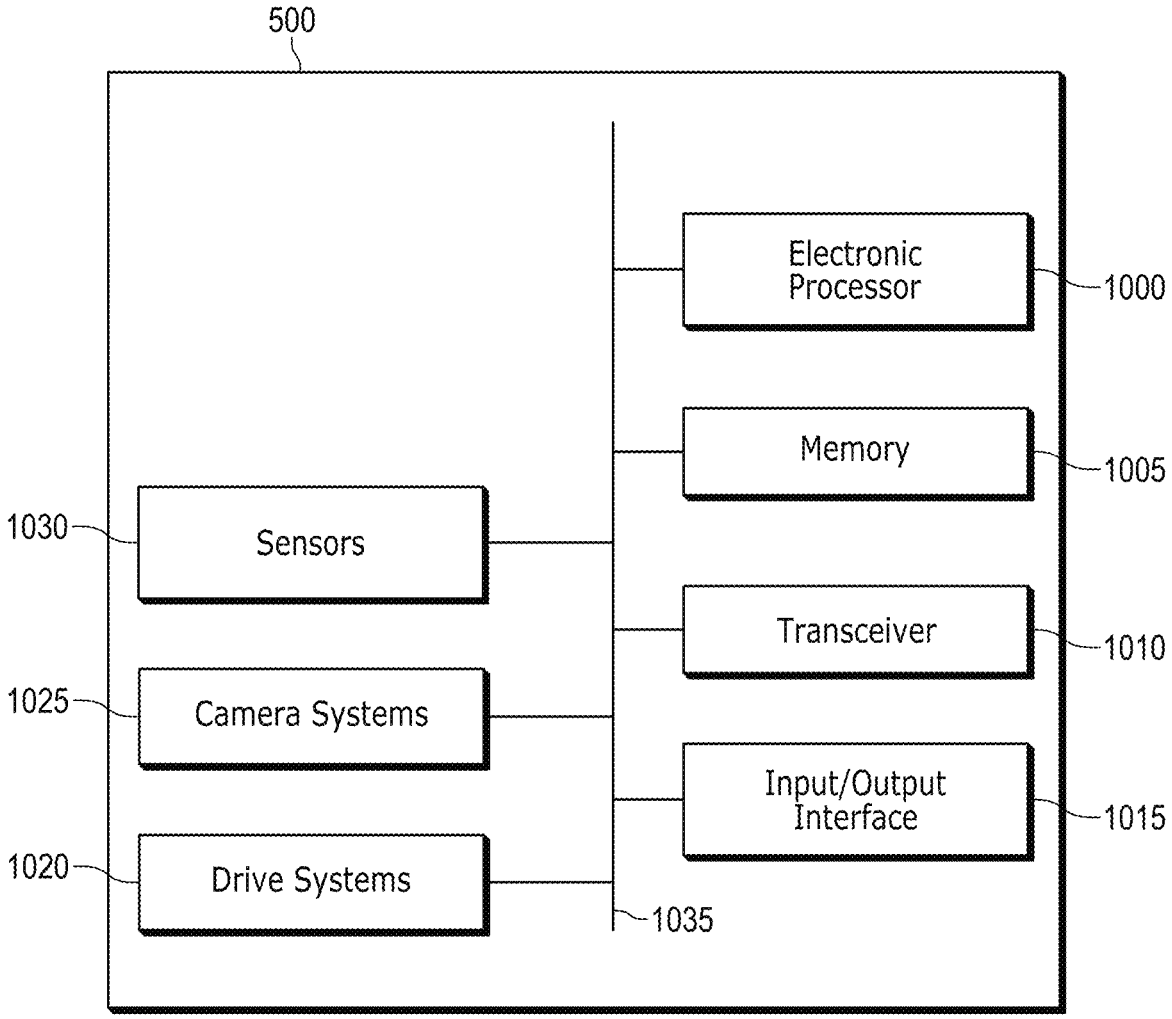
FIG. 16 is a block diagram of the automatic blister card packager of FIG. 6 in accordance with some examples.

FIG. 16 is a block diagram of an example automatic blister card packager 500. In the example illustrated, the automatic blister card packager 500 includes an electronic processor 1000, a memory 1005, a transceiver 1010, and input/output interface 1015, drive systems 1020, camera systems 1025, and sensors 1030. The electronic processor 1000, the memory 1005, the transceiver 1010, the input/output interface 1015, the drive systems 1020, the camera systems 1025, and the sensors 1030 communicate over one or more control and/or data buses (e.g., a communication bus 1035). The automatic blister card packager 500 may include more or fewer components than those illustrated in FIG. 16. The electronic processor 1000, the memory 1005, the transceiver 1010, and the input/output interface 1015 may be implemented similar to the electronic processor 300, the memory 305, the transceiver 310, and the input/output interface 315.

The drive systems 1020 include, for example, the various drive systems mentioned above for driving the first rail system 605, the second rail system 620, the sealing assembly 200, the loading station 800 (e.g., motors and suction systems), the discharging station 900 (e.g., motors and suction systems), and the like. The drive systems 1020 may include a separate electronic processor and memory for controlling the motors, solenoids, etc. The camera systems 1025 include, for example, the various cameras and camera systems mentioned above, for example, the vision system 240, the first verification camera system 700, the second verification camera system 710, and the like. The sensors 1030 may include, for example, the vision system 240 and other sensors of the automatic blister card packager 500.

Figure 17:
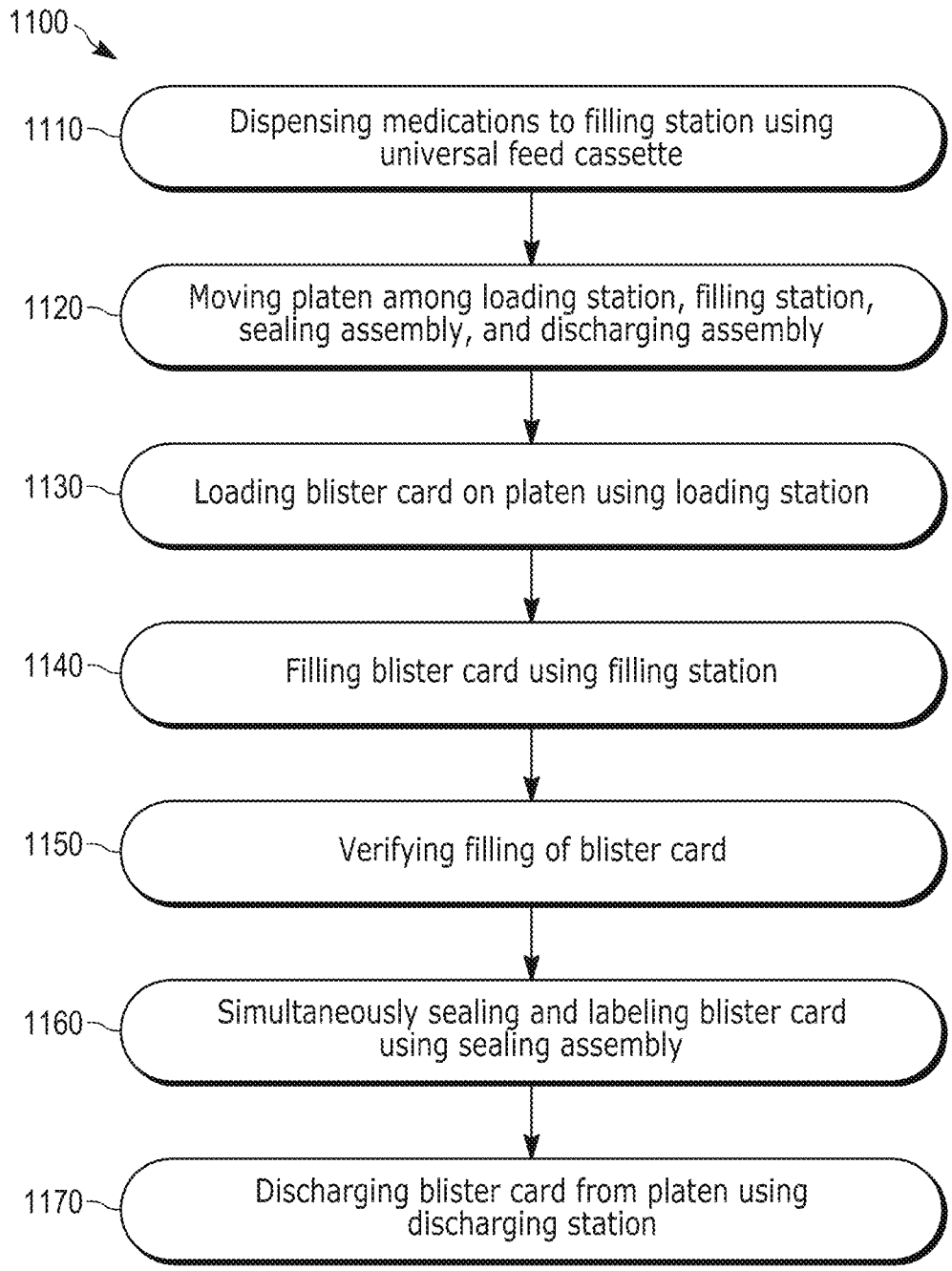
FIG. 17 is a flowchart of an example process implemented by the automatic blister card packager of FIG. 6 in accordance with some examples.

FIG. 17 illustrates a flowchart of an example process 1100 implemented by the automatic blister card packager 500 during operation. The operations of the process 1100 may or may not be performed in order. Some operations may be performed simultaneously with other operations. That is, some of the processes described below are performed at the same time to decrease the packaging time. The process 1100 includes dispensing medications to the filling station 545 using the universal feed cassette 535 (at operation 1110). The electronic processor 1000 controls the universal feed cassette 535 to dispense medications individually to the filling station 545.

The process 1100 includes moving the platen 245 among the loading station 800, the filling station 545, the sealing assembly 200, and the discharging station 900 (at operation 1120). The electronic processor 1000 controls the first rail drive 615 and the second rail drive 625 to move the platen 245 among the loading station 800, the filling station 545, the sealing assembly 200, and the discharging station 900. One or more position sensors may be used to detect the current position of the platen 245 to control the movement of the platen 245. Within the automatic blister card packager 500, a front-back axis is defined as, for example, a first axis. The filling station 545 is positioned at a back of the automatic blister card packager 500 whereas the loading station 800, the sealing assembly 200, and the discharging station 900 are positioned at a front of the automatic blister card packager 500. The first rail system 605 is used to move the platen 245 along the front-back axis (i.e., the first axis). The electronic processor 1000 controls the first rail drive 615 to move the platen 245 along the first axis.

Within the automatic blister card packager 500, a side-side axis (e.g., left-right axis) is defined as, for example, a second axis. In the examples illustrated, the loading station 800 is provided on a right side, the sealing assembly 200 is provided in the middle, the discharging station 900 is provided on a left side along the second axis. In other examples, the loading station 800 may be provided on the left side and the discharging station 900 may be provided on the right side. In still other examples, the loading station 800, the sealing assembly 200, and the discharging station 900 may be arranged in a front-back manner and/or in a non-linear manner. The second rail system 620 is used to move the platen 245 along the second axis. The electronic processor 1000 controls the second rail drive 625 to move the platen 245 along the second axis.

Movement between or among the various locations of the platen 245 is therefore achieved by controlling the first rail drive 615 and the second rail drive 625. For example, when an initial position of the platen 245 is the discharging station 900, a movement to the loading station 800 to collect an empty blister card 100 is achieved by controlling the second rail drive 625. For example, the electronic processor 1000 may control the second rail drive 625 to move the platen 245 along the second axis from the discharging station 900 to the loading station 800.

Moving the platen 245 from the loading station 800 to the filling station 545 may include controlling the first rail drive 615 and the second rail drive 625. For example, the electronic processor 1000 may first control the first rail drive 615 to move the platen 245 along the first axis to behind the loading station 800. The electronic processor 1000 then controls the second rail drive 625 to move the platen 245 from behind the loading station 800 to the filling station 545.

Moving the platen 245 from the filling station 545 to the sealing assembly 200 may include controlling the first rail drive 615. For example, the electronic processor 1000 controls the first rail drive 615 to move the platen 245 from the filling station 545 to the sealing assembly 200. Moving the platen 245 from the sealing assembly 200 to the discharging station 900 may include controlling the second rail drive 625. For example, the electronic processor 1000 may control the second rail drive 625 for sealing and labeling (e.g., printing) a filled blister card 100 and moving the platen 245 from the sealing assembly 200 to the discharging station 900. Movement of the platen 245 among the various positions may be achieved in other ways than described above.

The process 1100 includes loading a blister card 100 on the platen 245 using the loading station 800 (at operation 1130). The electronic processor 1000 controls the first rail drive 615 and/or the second rail drive 625 to move the platen 245 to the loading station 800. The electronic processor 1000 controls the card loading assembly 810 and the platen 245 to load a blister card 100 on the platen 245 as described below with respect to method 1200.

The process 1100 includes filling the blister card 100 using the filling station 545 (at operation 1140). The electronic processor 1000 controls the universal feed cassette 535 and the platen 245 to fill the blister card 100. Once the blister card 100 is loaded on the platen 245, the electronic processor 1000 controls the first rail drive 615 and/or the second rail drive 625 to move the platen 245 to the filling station 545. The electronic processor 1000 controls the universal feed cassette 535 to dispense medications to the platen 245 when the platen 245 is at the filling station 545. For example, the electronic processor 1000 may move the platen 245 such that a row or column is aligned with the openings in the chute 540. Once aligned, the electronic processor 1000 controls the universal feed cassette 535 to dispense the medications through the corresponding tracks such that the medications fall into the blister compartments 120 aligned with the openings. When the aligned blister compartments 120 are filled, the electronic processor 1000 moves or indexes to the next row or column of the blister card 100 to fill the next row or column of the 100. This process is repeated until the blister card 100 is filled.

The process 1100 includes verifying filling of the blister card 100 (at operation 1150). The electronic processor 1000 uses the first verification camera system 700 and/or the second verification camera system 710 to verify filling of the blister card 100 as described below with respect to method 1300. The electronic processor 1000 controls the first verification camera system 700 and/or the second verification camera system 710 to capture one or more images of each (or a plurality of) the blister compartments 120 of the blister card 100 currently being filled. The one or more images may be captured after the medication is dropped into the blister compartment 120. The electronic processor 1000 may use image recognition techniques on the captured one or more images to ensure that only a correct type and/or number of medications is delivered to the blister compartment 120. The electronic processor 1000 may verify filling of all blister compartments 120 of the blister card 100.

In some examples, the first verification camera system 700 is used to capture images of the blister compartments 120 under the outlets of the chute 540 after each drop of the medication. The electronic processor 1000 processes the captured images to verify whether the medication is projecting out of the blister compartment 120. When the medication is projecting out of the blister compartment 120, the electronic processor 1000 may control the platen 245 to vibrate, for example, using the first rail drive 615 and/or the second rail drive 625 to settle the medication. The electronic processor 1000 may perform successive image captures and vibrations until the medication is settled inside the blister compartment 120 such that the medication may not be sheared when the platen 245 is controlled to move to the next blister compartment 120 (i.e., next indexed location) or when the platen 245 is moved out of the filling station 545.

In some examples, each blister compartment 120 included in a row of the blister card 100 may be filled simultaneously (or relatively simultaneously). In these examples, the electronic processor 1000 may control the first verification camera system 700 and/or the second verification camera system 710 to capture one or more images for each row of blister compartments 120 rather than for each blister compartment 120. In other examples, each blister compartment 120 included in a column of the blister card 100 may be filled simultaneously (or relatively simultaneously). In these examples, the electronic processor 1000 may control the first verification camera system 700 and/or second verification camera system 710 to capture one or more images for each column of blister compartments 120 rather than for each blister compartment 120. In some examples, the electronic processor 1000 captures an image of the entire blister card 100 after filling, for example, after all the desired pills or prescribed medications are dropped into the respective blister compartments 120.

The images of the medication captured by the second verification camera system 710 may be occluded due to the blister compartment. In one example, the second verification camera system 710 may therefore be used to verify the presence of a medication and the first verification camera system 700 may be used to detect the type and/or number of medications in the blister compartment 120. In one example, the first verification camera system 700 may capture the images of the blister compartments 120 through the openings of the filling cover 595 after each drop to verify that the correct type and number of medications were dispensed to each blister compartment 120. The second verification camera system 710 may capture the image of the blister card 100 as a whole after the blister card 100 is completely filled to provide an image of the filled blister card 100. In one example, the second verification camera system 710 captures an image of the filled blister card 100 after the last blister compartment 120 is filled but before the filled blister card 100 is sealed using the sealing assembly 200. In another example, the second verification camera system 710 captures an image of the filled blister card 100 after the filled blister card 100 is sealed using the sealing assembly 200. In this example, the platen 245 may return to the filling station 545 such that the second verification camera system 710 may capture the image before the platen 245 is moved to the discharging station 900. Alternatively, the second verification camera system 710 may be motorized and configured to move under the platen 245 after the filled blister card 100 is sealed while the platen 245 is in the discharging station 900 and move back out of the discharging station 900 before the filled blister card 100 is discharged.

The process 1100 includes simultaneously sealing and labeling (e.g., printing) the blister card 100 using the sealing assembly 200 (at operation 1160). The electronic processor 1000 controls the first rail drive 615 and/or the second rail drive 625 to move the platen 245 from the filling station 545 to the sealing assembly 200. The electronic processor 1000 controls the sealing assembly 200 and the platen 245 to apply the lid 130 to the filled blister card 100 as described above with respect to method 400.

The process 1100 includes discharging the blister card 100 from the platen 245 using the discharging station 900 (at operation 1170). The electronic processor 1000 controls the first rail drive 615 and the second rail drive 625 to move the platen 245 from the sealing assembly 200 to the discharging station 900. The electronic processor 1000 controls the card discharging assembly 910 to discharge the blister card 100 from the platen 245 as described below with respect to method 1300.

Figure 18:
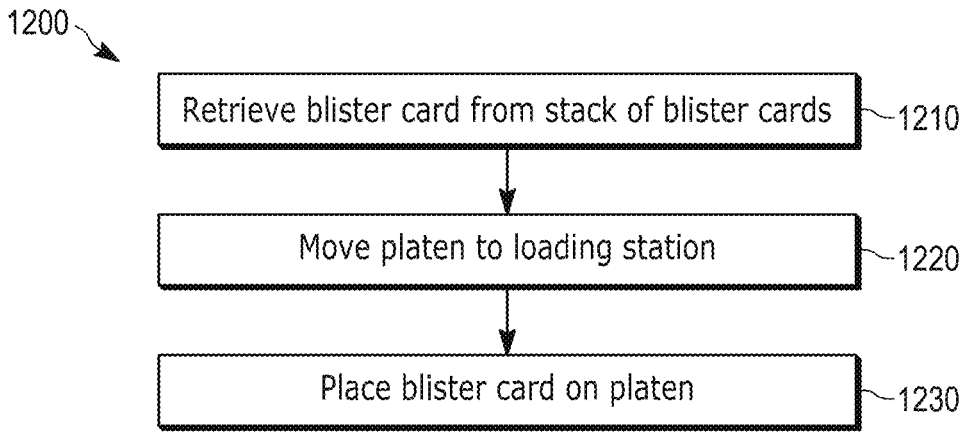
FIG. 18 is a flowchart of an example method for loading a blister card using the automatic blister card packager of FIG. 6 in accordance with some examples.

FIG. 18 is a flowchart illustrating one example method 1200 for loading a blister card 100 using the automatic blister card packager 500. As illustrated in FIG. 18, the method 1200 includes retrieving, using the loader plate 830, a blister card 100 from a stack of blister cards 100 (at block 1210). The card plate 825 holds a stack of blister cards 100. In one example, the electronic processor 1000 moves the loader plate 830 to the top of the stack of blister cards 100. The electronic processor 1000 controls, for example, the loader drive assembly 820 or a different drive mechanism to move the loader plate 830 downwards to the top of the stack of blister cards 100. In some examples, the loader plate 830 may be stationary and the card plate 825 may be moved upwards to the loader plate 830 using the loader drive assembly 820. The electronic processor 1000 may activate a suction system (e.g., a suction motor) of the loader plate 830 to generate a suction force through the one or more nozzles 850. The suction force results in the blister card 100 being picked up by the loader plate 830. The electronic processor 1000 may activate the suction system in response to or after the loader plate 830 is at the top of the blister card 100. In some examples, a different mechanism such as a robotic arm or the like may be used to retrieve the blister card 100 using the loader plate 830. Once the blister card 100 is retrieved by the loader plate 830, the electronic processor 1000 may move the loader plate 830 upward (or move the card plate 825 downward) to the initial position.

The method 1200 includes moving the platen 245 to the loading station 800 (at block 1220). The electronic processor 1000 controls the first rail drive 615 and/or the second rail drive 625 to move the platen 245 to the loading station 800 as described above. The electronic processor 1000 may move the platen 245 to the loading station 800 in response to or after the blister card 100 is retrieved by the loader plate 830. The electronic processor 1000 may control the first rail drive 615 and/or the second rail drive 625 to align the platen 245 with the blister card 100.

The method 1200 includes placing, using the loader plate 830, the blister card 100 on the platen 245 (at block 1230). The electronic processor 1000 may deactivate the suction system of the loader plate 830 to drop (e.g., deposit) the blister card 100 on the platen 245. The suction system may be deactivated in response to or after the platen 245 is moved to the loading station 800. In some examples, the loader plate 830 may be moved downward to the platen 245 to bring the blister card 100 closer to the platen 245 before the suction system is deactivated. In some examples, a positive pressure may be applied using the suction system to drop the blister card 100 from the loader plate 830. The platen 245 may be moved to the filling station 545 after the blister card 100 is loaded to fill the blister card 100.

In some examples, the method 1200 may further include moving the card plate 825 upward by a certain distance in response to or after a blister card 100 is retrieved from the stack of blister cards 100. The distance is, for example, 0.06 inches and corresponds to a dimension (e.g., a height) of each blister card 100 in the stack of blister cards 100. The card plate 825 may be moved upward by the screw 835 and the motor 840. In other examples, the card plate 825 may be biased upwardly by, for example, one or more springs. Moving the card plate 825 upwardly an incremental amount after each blister card 100 is retrieved from the stack of blister cards 100 maintains the next blister card 100 to be removed at the same position (e.g., vertical height) relative to the loader plate 830. As such, the loader plate 830 can move the same distance each time to retrieve a blister card 100 and does not need to adjust based on the number of blister cards 100 remaining in the stack of blister cards 100.

Figure 19:
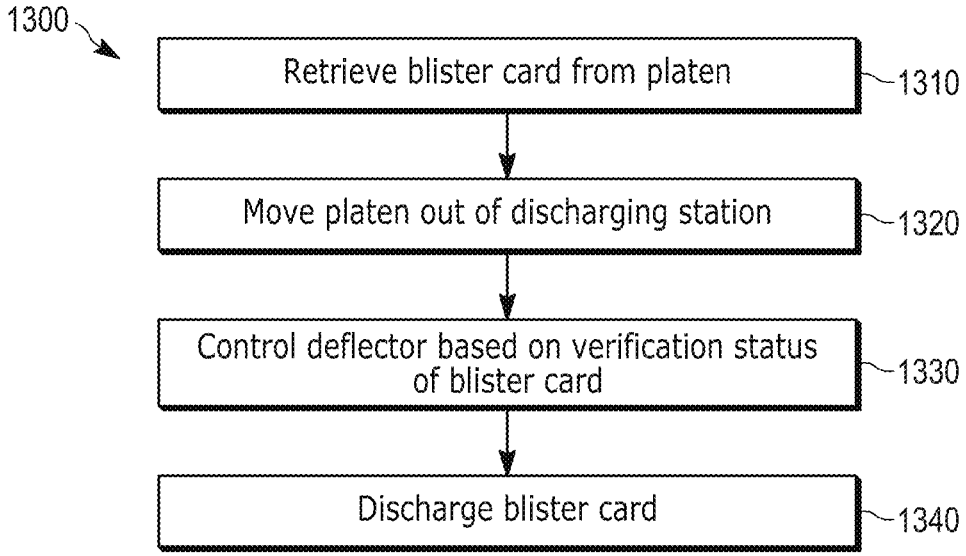
FIG. 19 is a flowchart of an example method for discharging a filled blister card using the automatic blister card packager of FIG. 6 in accordance with some examples.

FIG. 19 is a flowchart illustrating one example method 1300 for discharging a filled blister card 100 using the automatic blister card packager 500. As illustrated in FIG. 19, the method 1300 includes retrieving, using the discharger plate 930, a blister card 100 from the platen 245 (at block 1310). The electronic processor 1000 controls, for example, the discharger drive assembly 920 or a different drive mechanism to move the discharger plate 930 downwards to the top of the platen 245. The electronic processor 1000 may activate a suction system (e.g., a suction motor) of the discharger plate 930 to generate a suction force through the one or more nozzles 925. The suction force results in the blister card 100 being picked up by the discharger plate 930. The electronic processor 1000 may activate the suction system in response to or after the platen 245 is at the discharging station 900 and/or aligned with the discharger plate 930. In some examples, a different mechanism such as a robotic arm or the like may be used to retrieve the blister card 100 using the discharger plate 930. Once the blister card 100 is picked up by the discharger plate 930, the electronic processor 1000 may move the discharger plate 930 upward to the initial position.

The method 1300 includes moving the platen 245 out of the discharging station 900 (at block 1320). The electronic processor 1000 controls the first rail drive 615 and/or the second rail drive 625 to move the platen 245 out of the discharging station 900. For example, the platen 245 may be moved to the loading station 800 to retrieve the next blister card 100. The electronic processor 1000 may move the platen 245 out of the discharging station 900 in response to or after the blister card 100 is retrieved by the discharger plate 930. The electronic processor 1000 may control the first rail drive 615 and/or the second rail drive 625 to align the platen 245 with the blister card 100.

The method 1300 includes controlling the deflector 935 based on the verification status of the blister card 100 (at block 1330). Each filled blister card 100 may be verified using a verification system. For example, each filled blister card 100 may be verified as described above with respect to operation 1150. The electronic processor 1000 determines whether the blister card 100 is correctly packaged or incorrectly packaged based on the verification performed at operation 1150. The electronic processor 1000 controls the deflector 935 based on the verification status. For example, the electronic processor 1000 controls deflector 935 using the motor 840 to be in one of the first position (shown in FIG. 14) or the second position (shown in FIG. 15) when the blister card 100 is correctly packaged and in the other of the first position or the second position when the blister card 100 is incorrectly packaged.

The method 1300 includes discharging, using the discharger plate 930, the blister card 100 (at block 1340). The electronic processor 1000 may deactivate the suction system of the discharger plate 930 to drop the blister card 100 in the discharging enclosure 905. The suction system may be deactivated in response to or after the platen 245 is moved out of the discharging station 900 and/or the after the deflector 935 is in a position corresponding to the verification status of the blister card 100. As the suction system is deactivated, the blister card 100 drops from the discharger plate 930 and either falls out of the discharging enclosure 905 or the automatic blister card packager 500 when the deflector 935 is in the path of the blister card 100 or falls into the discharging enclosure 905 when the deflector 935 is out of the path of the blister card 100. In one example, a tote or container may be provided outside the discharging enclosure 905 to receive the correctly filled blister cards 100. In another example, a conveyor belt may be provided outside the discharging enclosure 905 in the path of filled blister card 100 when the deflector 935 is in the first position. The conveyor below may receive the filled blister cards 100 and may be configured to carry the filled blister cards 100 to another location within the facility. When the deflector 935 is in the path of the blister card 100, the deflector 935 guides the blister card 100 out of the discharging enclosure 905 into the tote, container, or conveyor belt. In some examples, the deflector 935 may direct the blister card 100 to a different part of the discharging enclosure 905 rather than out of the discharging enclosure 905 or out of the automatic blister card packager 500. The incorrectly filled blister cards 100 may be directed to within the discharging enclosure 905 to be collected later. In some instances, the verification system may incorrectly determine that the blister card 100 is incorrectly filled. In these instances, the pharmacist or technician may manually verify the filled blister cards 100 that are deemed to be incorrectly filled by the verification system before being discarded or accepted.

Example 1. A sealing assembly comprising: a lid roll dispensing a lid for a blister card; and a print roller configured to simultaneously apply the lid from the lid roll on the blister card and print information related to the blister card on the lid.

Example 2. The sealing assembly of Example 1, further comprising: a platen configured to hold the blister card while the blister card is filled with medications, wherein the lid is applied to the blister card while the blister card is supported by the platen; and a lid roll holder assembly including a plurality of holders for holding the lid roll.

Example 3. The sealing assembly of Example 2, wherein the plurality of holders includes: a feed holder configured to hold an unspent portion of the lid roll; and a take-up holder configured to hold a spent portion of the lid roll.

Example 4. The sealing assembly of Example 3, wherein the plurality of holders further includes a guide holder for guiding the lid roll between the feed holder and the take-up holder.

Example 5. The sealing assembly of Example 3, further comprising a guider assembly configured to guide the lid from the feed holder to the print roller.

Example 6. The sealing assembly of Example 5, wherein the guider assembly is configured such that an action of rolling the lid roll through the guider assembly results in a peeling of the lid from the lid roll.

Example 7. The sealing assembly of Example 3, wherein the platen and the lid roll holder assembly are configured to align the lid with the blister card prior to simultaneously applying the lid from the lid roll on the blister card and printing information related to the blister card on the lid.

Example 8. The sealing assembly of Example 2, further comprising: a vision system; a drive system for controlling at least one of the platen and the lid roll holder assembly; and an electronic processor electrically coupled to the vision system, the drive system, and the print roller and configured to: align, using the vision system and the drive system, the lid with the blister card; and control the print roller to simultaneously apply the lid from the lid roll on the blister card and print information related to the blister card on the lid while the blister card is supported by the platen in response to aligning the lid with the blister card.

Example 9. The sealing assembly of any of Examples 1-8, wherein the print roller is further configured to apply a pressure on the lid to activate an adhesive mechanism of the lid.

Example 10. An automatic blister card packager comprising: a platen configured to hold a blister card while the blister card is filled with medications; and a sealing assembly configured to simultaneously apply a lid to the filled blister card and print on the lid while the filled blister card is supported by the platen.

Example 11. The automatic blister card packager of Example 10, wherein the sealing assembly includes: a lid roll dispensing a lid for the blister card; and a print roller configured to apply the lid from the lid roll on the blister card and print information related to the blister card on the lid.

Example 12. The automatic blister card packager of Example 11, wherein the sealing assembly further includes a lid roll holder assembly including a plurality of holders for holding the lid roll.

Example 13. The automatic blister card packager of Example 12, wherein the plurality of holders includes: a feed holder configured to hold an unspent portion of the lid roll; and a take-up holder configured to hold a spent portion of the lid roll.

Example 14. The automatic blister card packager of Example 13, wherein the plurality of holders further includes a guide holder for guiding the lid roll between the feed holder and the take-up holder.

Example 15. The automatic blister card packager of Example 13, wherein the sealing assembly further includes a guider assembly configured to guide the lid from the feed holder to the print roller.

Thus, the present disclosure provides, among other things, a sealing system for blister cards.

What is claimed is:

1. A sealing assembly comprising:

a lid roll dispensing a lid for a blister card; and a print roller configured to simultaneously apply the lid from the lid roll on the blister card and print information related to the blister card on the lid.

2. The sealing assembly of claim 1, further comprising:

a platen configured to hold the blister card while the blister card is filled with medications, wherein the lid is applied to the blister card while the blister card is supported by the platen; and a lid roll holder assembly including a plurality of holders for holding the lid roll.

3. The sealing assembly of claim 2, wherein the plurality of holders includes:

a feed holder configured to hold an unspent portion of the lid roll; and a take-up holder configured to hold a spent portion of the lid roll.

4. The sealing assembly of claim 3, wherein the plurality of holders further includes a guide holder for guiding the lid roll between the feed holder and the take-up holder.

5. The sealing assembly of claim 3, further comprising a guider assembly configured to guide the lid from the feed holder to the print roller.

6. The sealing assembly of claim 5, wherein the guider assembly is configured such that an action of rolling the lid roll through the guider assembly results in a peeling of the lid from the lid roll.

7. The sealing assembly of claim 3, wherein the platen and the lid roll holder assembly are configured to align the lid with the blister card prior to simultaneously applying the lid from the lid roll on the blister card and printing information related to the blister card on the lid.

8. The sealing assembly of claim 2, further comprising:

a vision system;

a drive system for controlling at least one of the platen and the lid roll holder assembly; and an electronic processor electrically coupled to the vision system, the drive system, and the print roller and configured to:

align, using the vision system and the drive system, the lid with the blister card; and control the print roller to simultaneously apply the lid from the lid roll on the blister card and print information related to the blister card on the lid while the blister card is supported by the platen in response to aligning the lid with the blister card.

9. The sealing assembly of claim 1, wherein the print roller is further configured to apply a pressure on the lid to activate an adhesive mechanism of the lid.

10. An automatic blister card packager comprising:

a platen configured to hold a blister card while the blister card is filled with medications, wherein a lid is applied to the filled blister card while the filled blister card is supported by the platen; and a sealing assembly configured to simultaneously apply the lid to the filled blister card and print on the lid, the sealing assembly including a lid roll dispensing the lid for the blister card; and a print roller configured to apply the lid from the lid roll on the blister card and print information related to the blister card on the lid.

11. The automatic blister card packager of claim 10, wherein the sealing assembly further includes a lid roll holder assembly including a plurality of holders for holding the lid roll.

12. The automatic blister card packager of claim 11, wherein the plurality of holders includes:

a feed holder configured to hold an unspent portion of the lid roll; and a take-up holder configured to hold a spent portion of the lid roll.

13. The automatic blister card packager of claim 12, wherein the plurality of holders further includes a guide holder for guiding the lid roll between the feed holder and the take-up holder.

14. The automatic blister card packager of claim 12, wherein the sealing assembly further includes a guider assembly configured to guide the lid from the feed holder to the print roller.

* * * * *